US006457309B1

(12) United States Patent
Firey

(10) Patent No.: US 6,457,309 B1
(45) Date of Patent: Oct. 1, 2002

(54) MULTIFUEL INTERNAL COMBUSTION STIRLING ENGINE

(76) Inventor: Joseph Carl Firey, P.O. Box 15514, Seattle, WA (US) 98115-0514

( * ) Notice: Subject to any disclaimer, the term of this patent is extended or adjusted under 35 U.S.C. 154(b) by 0 days.

(21) Appl. No.: 10/074,769

(22) Filed: Feb. 14, 2002

Related U.S. Application Data

(63) Continuation-in-part of application No. 09/859,263, filed on May 18, 2001, now abandoned.

(51) Int. Cl.[7] ..... F01B 29/10
(52) U.S. Cl. ..... 60/517; 60/524
(58) Field of Search ..... 60/517, 520, 524

(56) References Cited

U.S. PATENT DOCUMENTS 4,630,447 A * 12/1986 Webber ..... 60/712
5,050,570 A * 9/1991 Thring ..... 123/556
5,461,859 A * 10/1995 Beale et al. ..... 60/517
5,499,605 A * 3/1996 Thring ..... 123/70 R
6,293,231 B1 * 9/2001 Valentin ..... 123/46 R

* cited by examiner

*Primary Examiner*—Hoang Nguyen

(57) ABSTRACT

A multifuel internal combustion Stirling engine is described, wherein a compressor piston and a displacer piston reciprocate, within a common cylinder, to enclose a variable air volume, and a variable burned gas volume. Motion of these two pistons, creates a power producing cycle, of compression, combustion, expansion, and scavenge, wherein the burned gases do not contact those cylinder portions over which the compressor piston moves. In this way low engine wear can be obtained when using fuels such as coal, which produces abrasive particulates in the burned gases. A multifuel internal combustion engine of this invention can be readily adapted to operate on a wide variety of fuels, such as, natural gas, diesel fuel, residual petroleum fuel, and coal. Widespread use of these engines would introduce economic competition between these now separately competing fuels. This is a clear route to national energy independence, since coal reserves greatly exceed petroleum reserves, nationally and internationally.

16 Claims, 16 Drawing Sheets

SECTION I-I OF FIG. 12

SECTION II-II OF FIG. 15

SECTION I-I OF FIG. 14

MULTIFUEL INTERNAL COMBUSTION STIRLING ENGINE

(A) CROSS REFERENCE TO RELATED APPLICATIONS

Figures 1A, 1B, 1C:
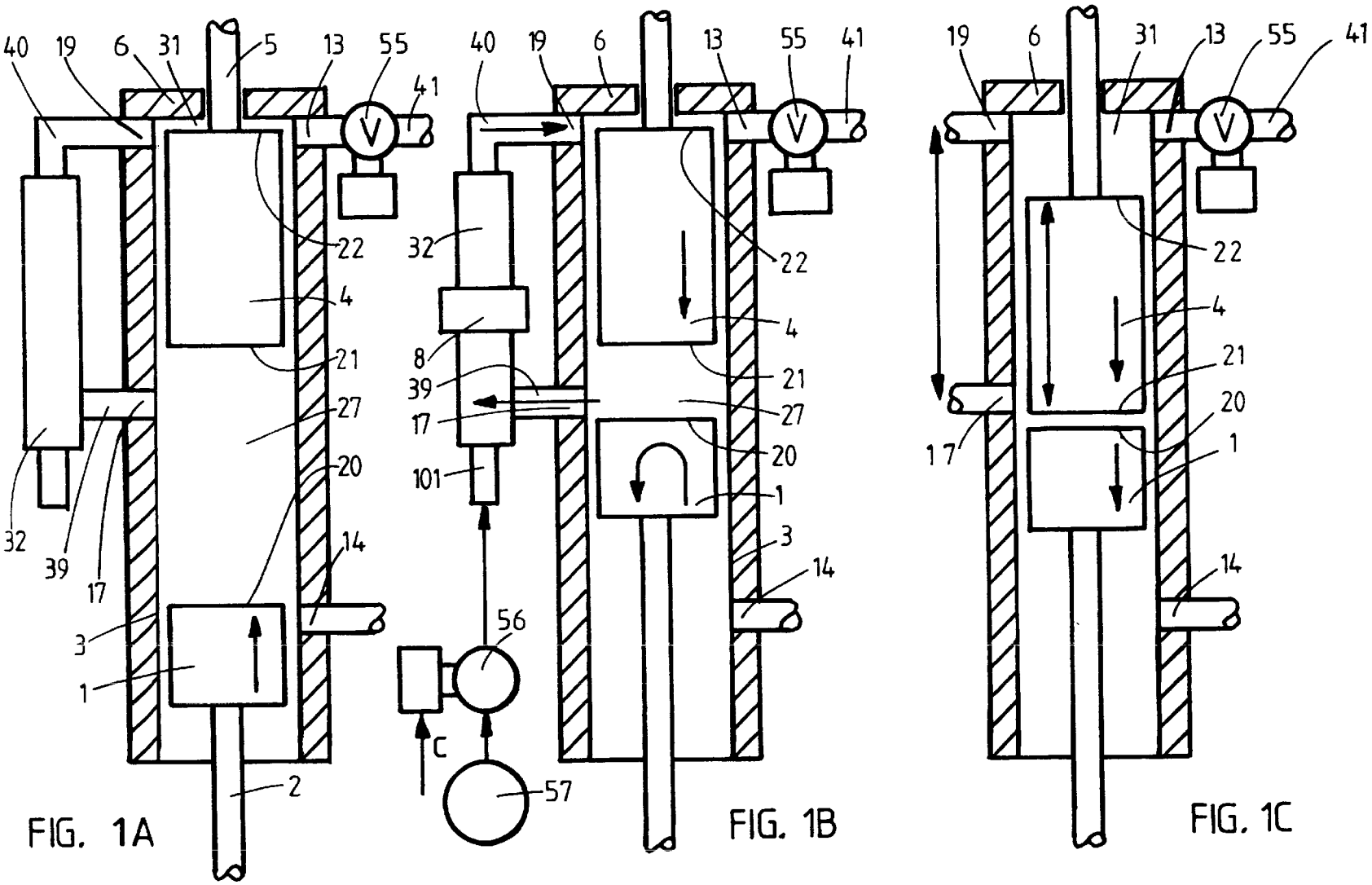

This patent application is a continuation-in-part of my earlier filed U.S. patent application, Ser. No. 09/859,263, entitled, "Internal Combustion Stirling Engine," filed May 18, 2001 Now Abandoned, GAU 3748;

The invention described herein is related to my following issued U.S. Patents:

1. U.S. Pat. No. 5,479,893, "Combined Reactor for Cyclic Char Burning Engines," issued Jan. 2, 1996;
2. U.S. Pat No. 5,485,812, "Multiple Sources Refuel Mechanism," issued Jan. 23, 1996;
3. U.S. Pat No. 5,931,123, "Fuel Injector for Slurry Fuels," issued Aug. 3, 1999;

The invention described herein is also related to my following U.S. Pat. application:

4. "Steam Driven Fuel Slurrifier," Ser. No. 09/699,327, filed Oct. 30, 2000;

(B) BACKGROUND OF THE INVENTION

1. Field of the Invention

This invention is principally in the field of internal combustion engines, and particularly internal combustion engines for burning solid fuels, such as coal or coke, as well as liquid and gas fuels. This invention is also related to the field of external combustion, Stirling cycle, engines.

2. Description of the Prior Art

Our national dependence on imported petroleum aggravates our trade imbalance and creates a wartime vulnerability to blockade. Greater use of domestic coal, particularly in transportation engines, could reduce both the vulnerability and the trade imbalance. Domestic coal reserves, as well as worldwide coal reserves, are much larger than petroleum or natural gas reserves. Additionally, coal is much less costly, per unit of energy, than natural gas or petroleum derived fuels. It has thus been recognized for some time that it would be very much in the national interest to have available an efficient and durable transportation engine, capable of operating on coal, or coal derived, solid fuels. Recent prior art efforts for this purpose have been largely directed along the following lines:

A. Slurries of coal particles suspended in water have been successfully and efficiently burned in essentially conventional diesel engines. But the resulting ash particles caused increased wear of engine cylinders and piston rings. Aggravated wear also occurred on the fuel injector nozzles. As a result, this development work has been discontinued. A summary of some of these developments is presented in the following reference: *"Coal Fueled Diesel Engines,* 1993," J. A. Caton and H. A. Webb, Editors, ASME Publ. No. ICE-Vol. 19, 1993.

B. Experiments using coal and coke in chunk form, on a fixed fuel bed, have been carried out for combustion in piston internal combustion engines. A two-stage combustion of coal gasification, followed by gas burnup, is described in my U.S. Pat. No. 4,412,511, Nov. 1, 1983. A single stage combustion is described in my U.S. Pat. No. 5,479,893, Jan. 2, 1996, and U.S. Pat. No. 5,485,812, Jan. 23, 1996. Abrasive ash particulates, carried over out of the fixed bed, being larger than slurry fuel particulates, would be capable of causing even greater cylinder and piston ring wear in conventional engines.

C. The Stirling cycle engine, originally developed by the Rev. Robert Stirling in the early 1800s, is an external combustion engine, capable of using almost any fuel, including coal. Recent developments of Stirling cycle engines, as substitutes for conventional internal combustion engines, are described in the following references:

(1) *"Stirling Engines,"* G. T. Reader and C. Hooper, E. & F. N. Spon, New York, 1983.

(2) *"Stirling Engines,"* G. Walker, Clarendon Press, Oxford, 1980; To achieve competitive fuel efficiency, and engine size, required the use of expensive superalloy materials, for the heat exchangers, and special seals, to contain the working fluids at very high pressures. As a result, these recently developed Stirling Cycle engines have failed to replace conventional internal combustion engines.

D. Internal combustion Stirling engines, using mechanisms essentially similar to those of external combustion Stirling cycle engines, have been developed, in various forms, during the past one hundred years. These internal combustion Stirling engines were developed starting in the late nineteenth century, in an effort to meet the competition of the conventional internal combustion engine, then undergoing development. Recent examples of these internal combustion Stirling engines are described by Thring, U.S. Pat. No. 5,499,605, and Webber, U.S. Pat. No. 4,630,447. These prior art internal combustion Stirling engines utilized fuels which did not create abrasive wear particles, and were not capable of durable operation on ash producing fuels, such as coal. The greater mechanical complexity of the Stirling engine mechanism, as compared to conventional internal combustion engines, prevented these prior art internal combustion Stirling engines from successfully competing against conventional internal combustion engines.

E. Our national energy independence could thus be greatly assisted if an efficient and durable coal burning engine were available, which avoided the abrasive wear problems due to using coal in conventional internal combustion engines, and avoided the high cost problems, due to superalloys and special seals in external combustion Stirling cycle engines.

DEFINITIONS

The term, "Stirling Cycle Engine," is used herein to refer to external combustion engines, operating on variations of the Stirling cycle invented by the Rev. Robert Stirling.

The term "internal combustion engine," is used herein, and in the claims, to refer to an engine wherein fuel and air are mixed together, and then ignited and burned to combustion products, and these gases act directly upon the work producing engine piston, to create the engine power output.

The term, "Swept volume," is used herein and in the claims to mean the volume added to or subtracted from the volume adjacent to the crown of a piston moving within a cylinder.

The term, "liquid fuel," is used herein and in the claims to include an homogeneous liquid fuel, such as gasoline or diesel fuel; a slurry of immiscible liquid fuel in water or other liquid, such as residual petroleum fuel suspended in water; a slurry of solid fuel suspended in a liquid, such as coal in water slurry fuel.

The term "solid fuel in chunks" is used herein and in the claims to refer to solid fuel, such as coal or coke, in chunks large enough that they cannot be suspended in a liquid slurry.

(C) SUMMARY OF THE INVENTION

A multifuel internal combustion Stirling engine of this invention uses two pistons, a displacer piston, and a compressor piston, reciprocating within a common cylinder, to carry out a power producing cycle.

Air enters the cylinder between the pistons, is compressed therebetween, is burned with an engine fuel while being displaced out of the volume between the pistons, through a combustion chamber and into a burned gas volume on the opposite side of the displacer piston. The burned gases are then expanded, producing a work output greater than the work input of compression. Following expansion, the burned gases are discarded and fresh air introduced into the cylinder between the pistons, for the next following cycle.

The mechanical components of this internal combustion Stirling engine are somewhat similar to the mechanical components of prior art Stirling cycle engines. But a multifuel internal combustion Stirling engine of this invention differs from a Stirling cycle engine, in that fuel is burned with the working fluid air inside the engine, and the burned gas discarded with each cycle, whereas the working fluid of a Stirling cycle engine is retained within the engine, through all of the repeated cycles, and is alternately heated and cooled to create a net work output. In a Stirling cycle engine the working fluid is not burned with a fuel, combustion occurring external to the engine, where the working fluid is to be heated.

To obtain adequate fuel efficiency from prior art external combustion, Stirling cycle engines requires the use of expensive superalloy materials for the heat exchangers, where the working fluid is heated. A principal beneficial object of the multifuel internal combustion Stirling engine of this invention is that internal combustion is used instead of a heat exchanger and these expensive superalloy heat exchangers are avoided.

When coal or other solid fuels are burned in conventional prior art internal combustion engines, the resulting abrasive ash particles cause severe engine wear and consequently increased engine maintenance costs. In a multifuel internal combustion Stirling engine of this invention, the burned gases containing the abrasive ash particles are retained within the burned gas volume and do not contact that portion of the cylinder over which the compressor piston moves. In this way ash particle wear of the engine is largely avoided, since the displacer piston is not pressure loaded and does not require use of gas tight seals, such as piston rings. This is another beneficial object of the multifuel internal combustion Stirling engines of this invention, that coal fuels and coal water slurry fuels can be used without excessive engine wear.

Widespread use of these multifuel internal combustion Stirling engines would introduce price and supply competition between the many different kinds of fossil fuels, such as coal, petroleum and natural gas. This economic competition is a clear way to energy independence, since coal reserves greatly exceed petroleum and natural gas reserves, both nationally and internationally.

(D) BRIEF DESCRIPTION OF THE DRAWINGS

Figure 2:
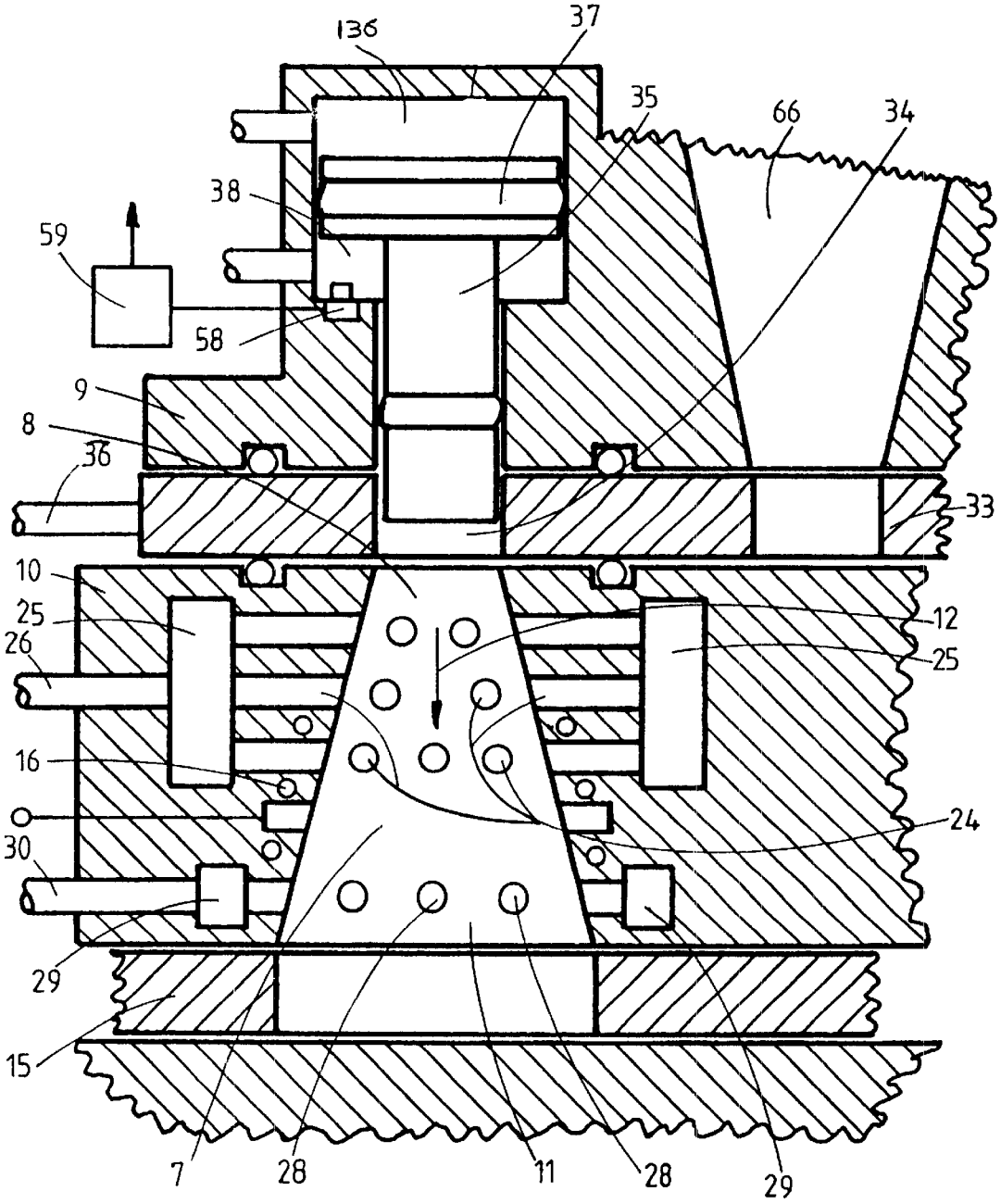
Figure 3:
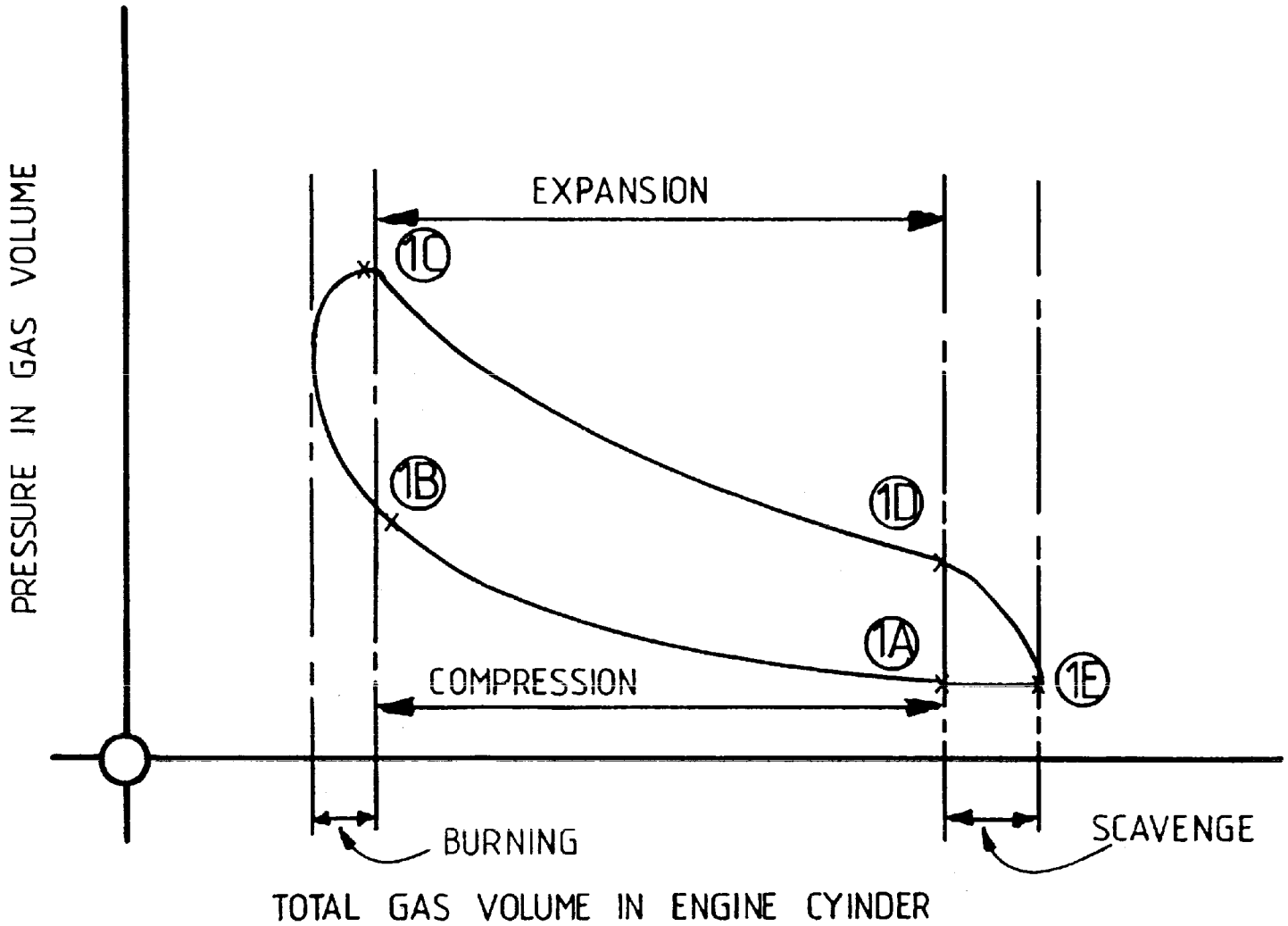
Figure 4:
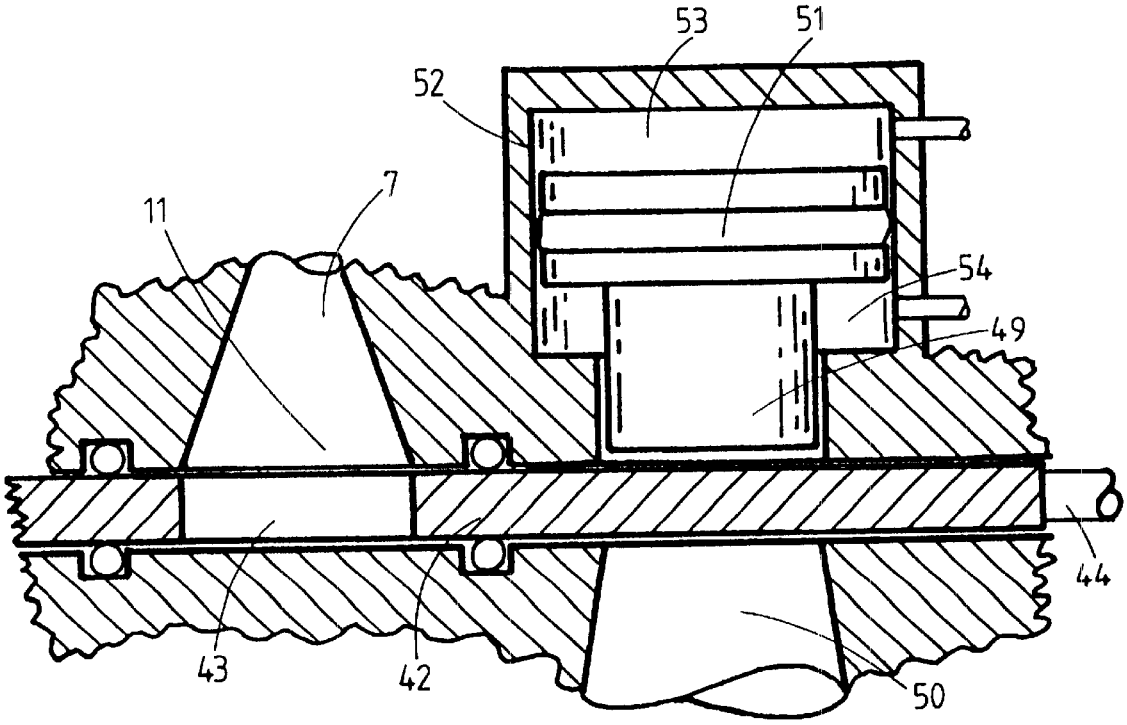
Figure 4:
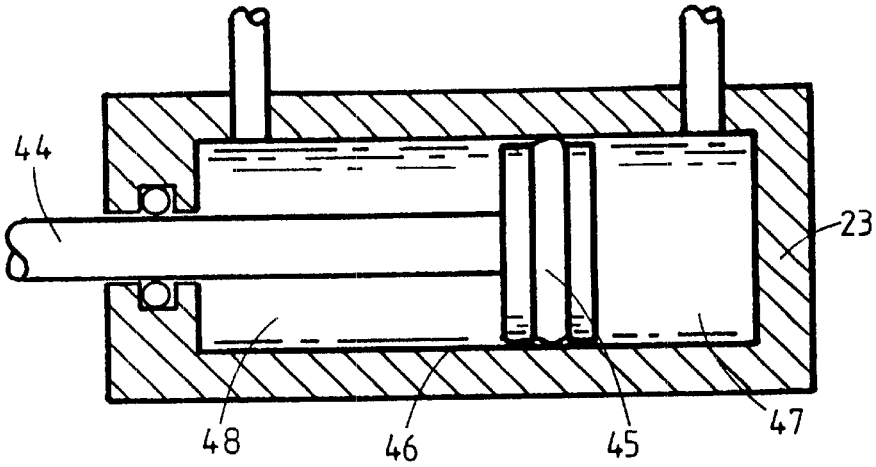
Figure 5:
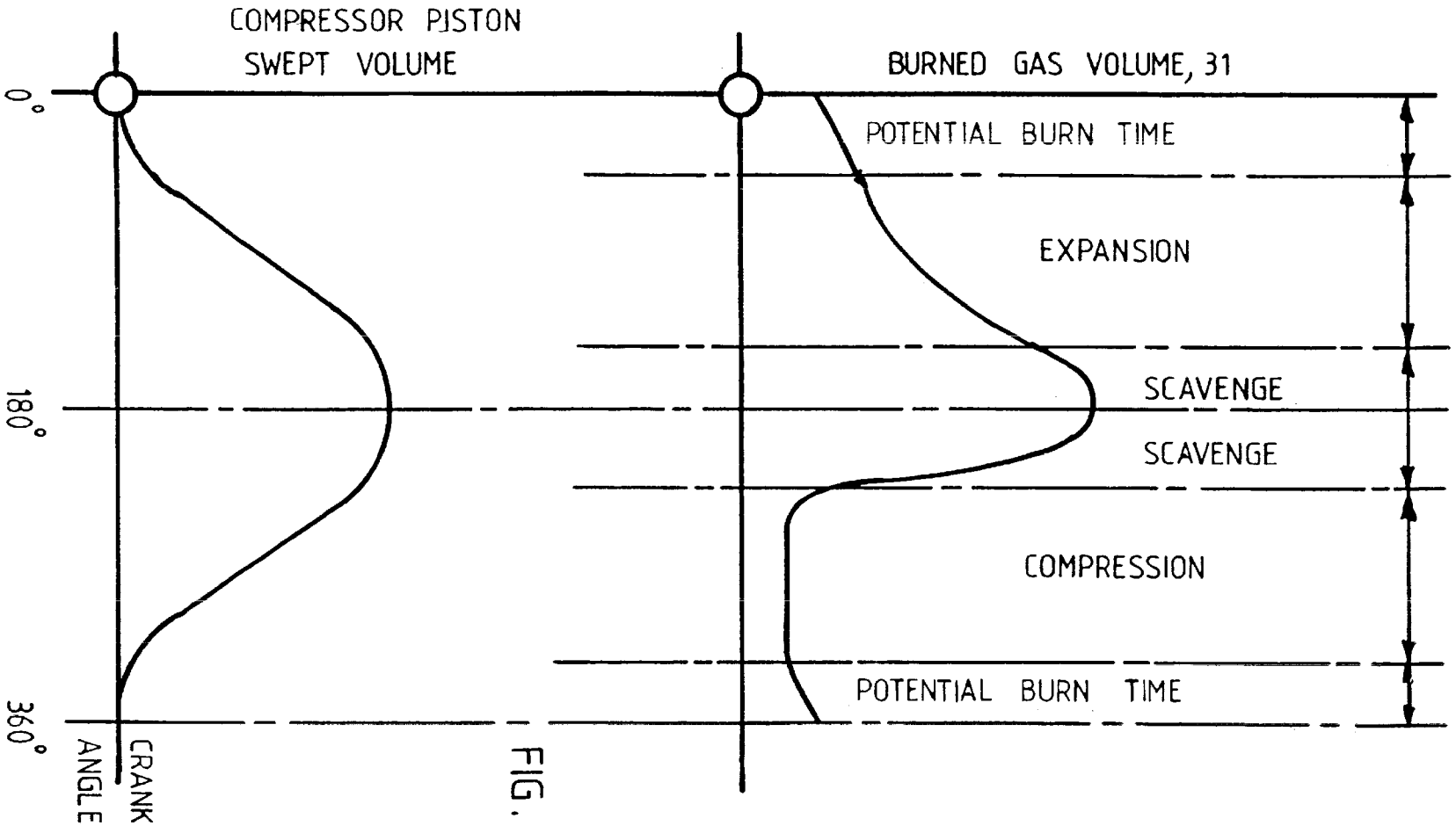
Figure 6:
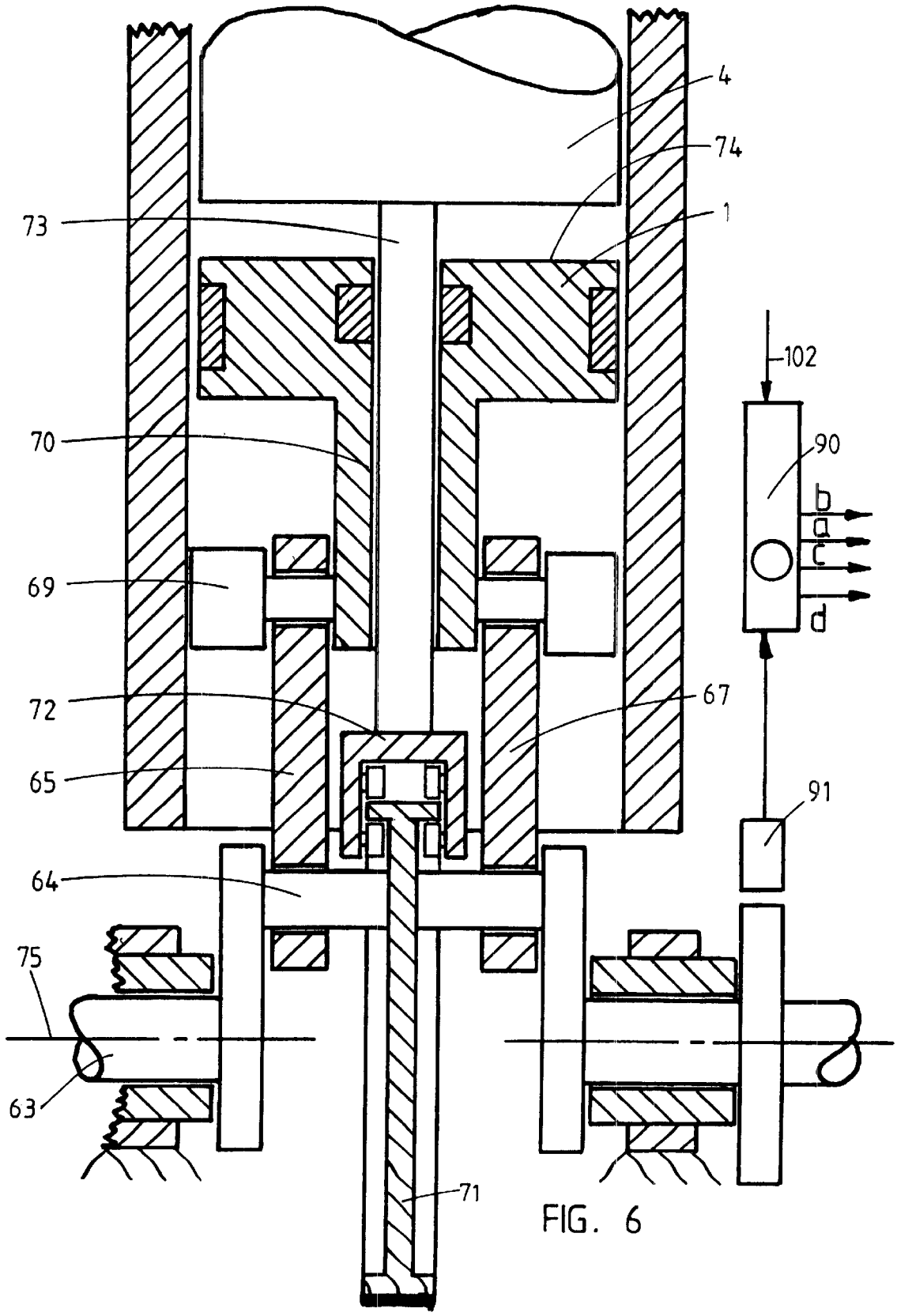
Figure 7:
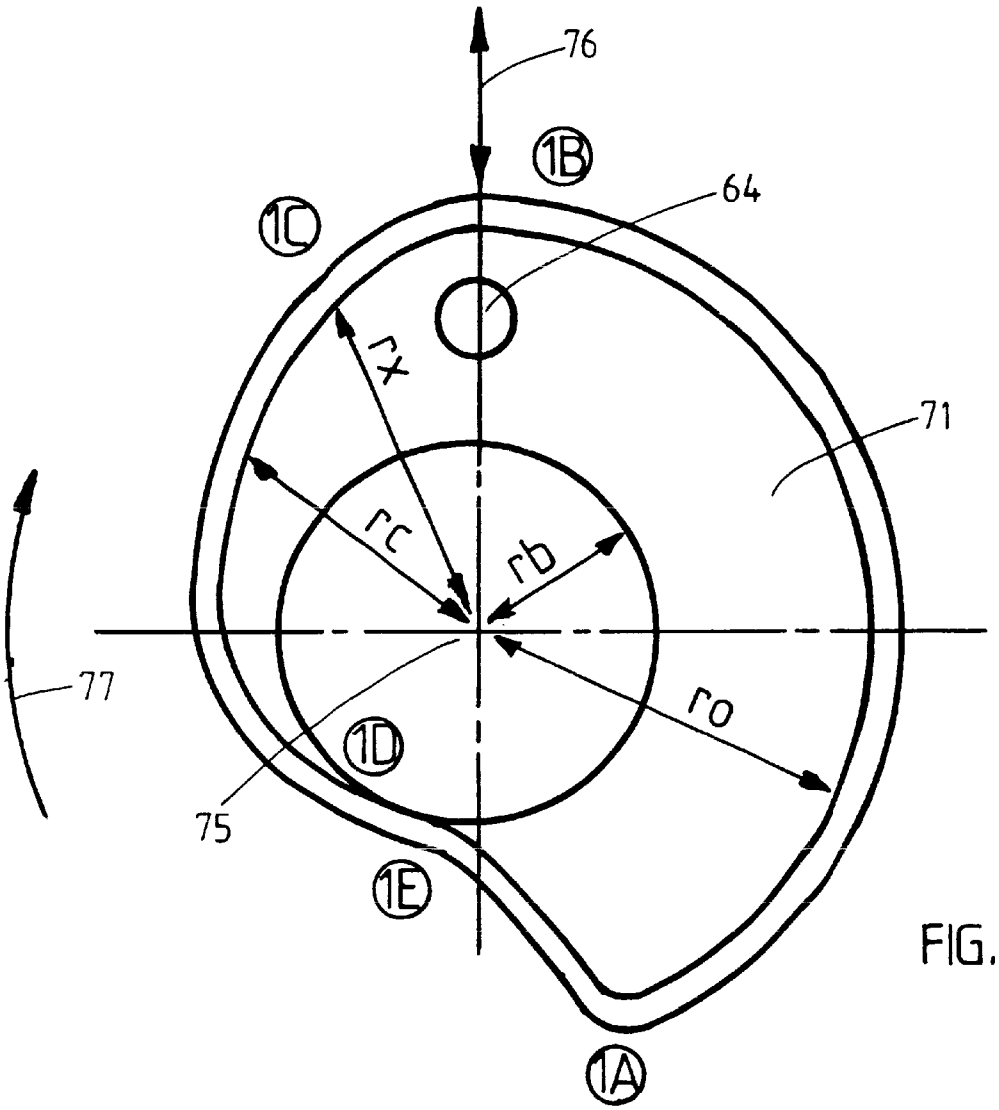
Figure 8:
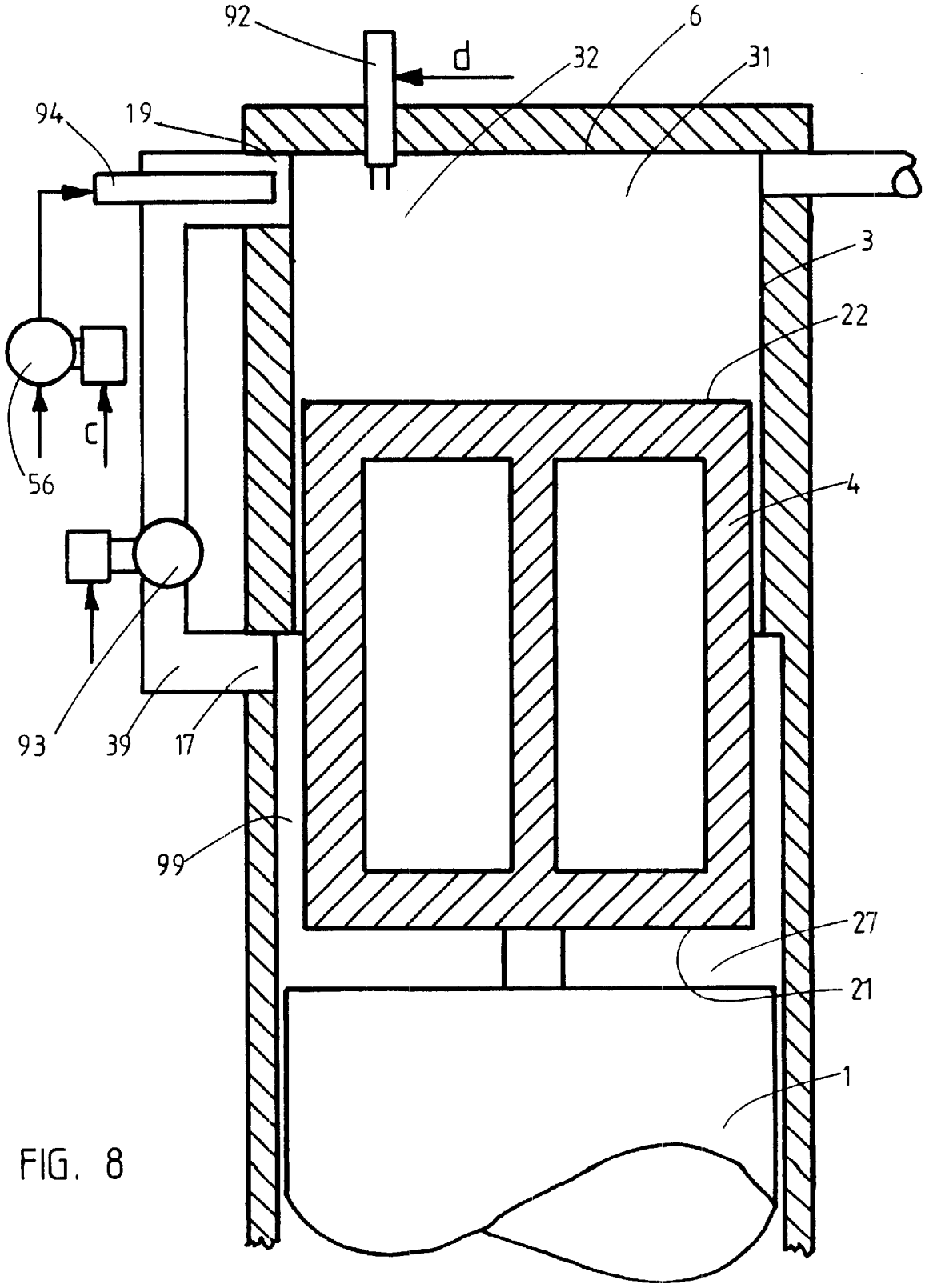
Figure 9:
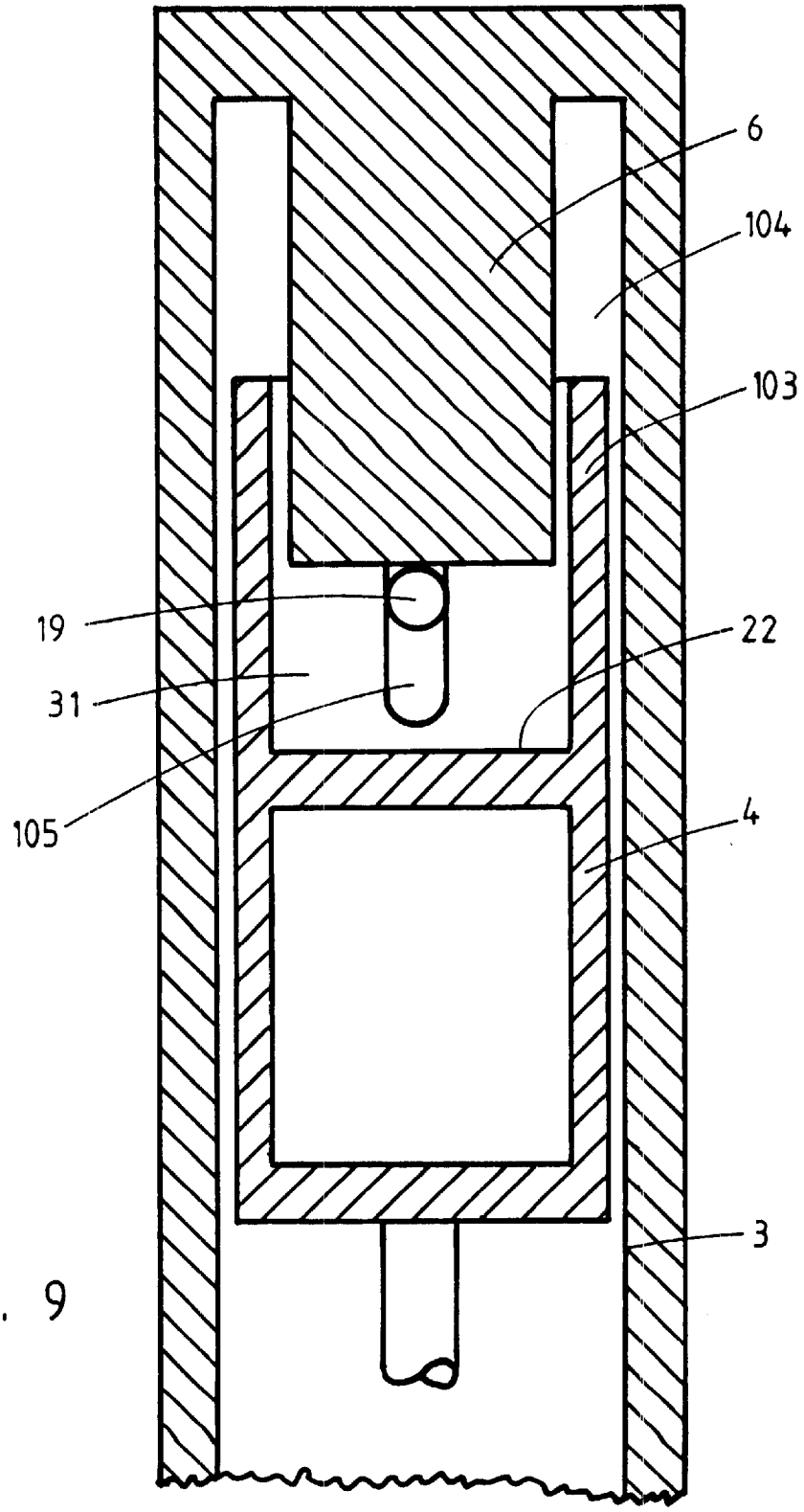
Figure 10:
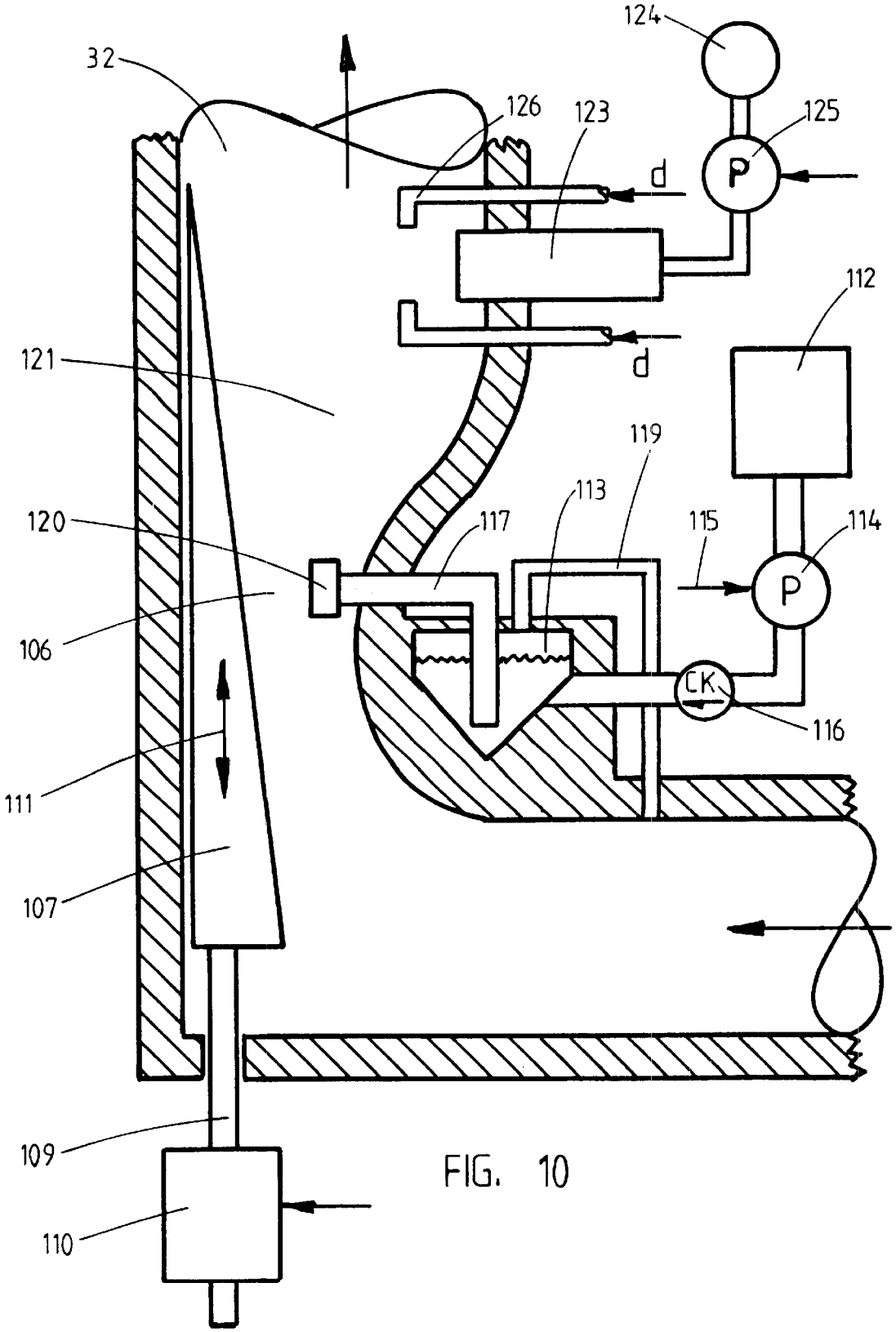
Figure 11:
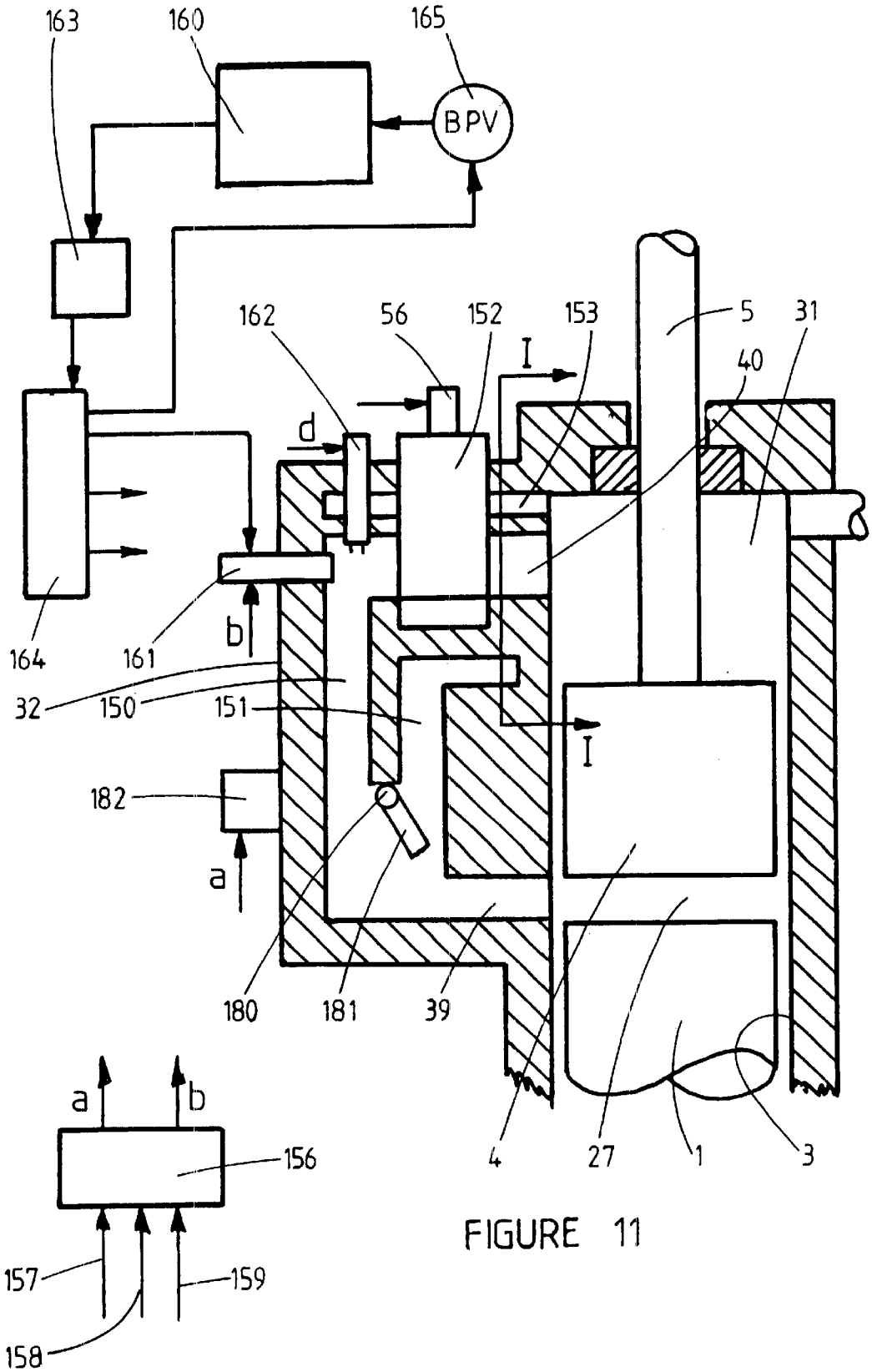
Figure 12:
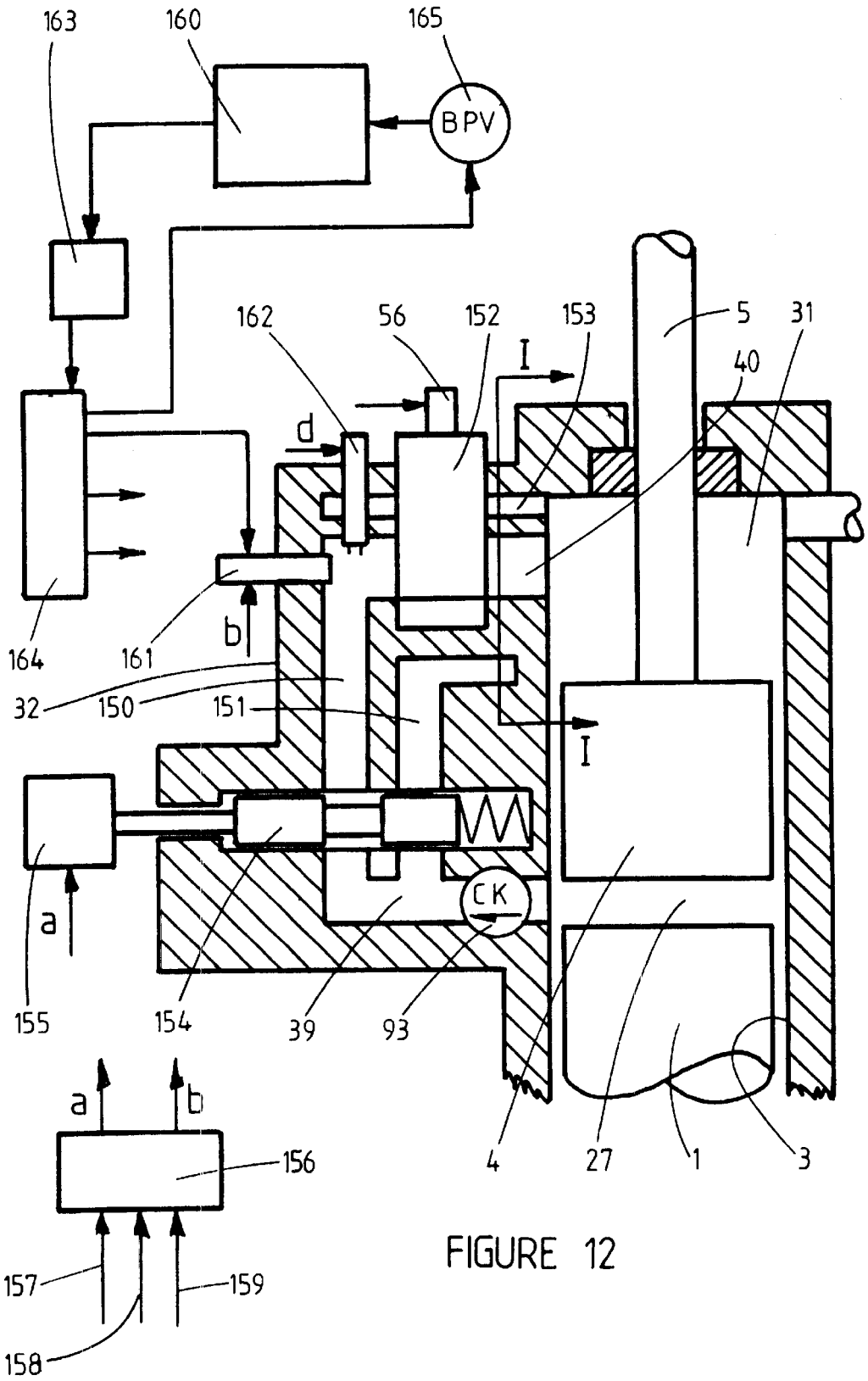
Figure 13:
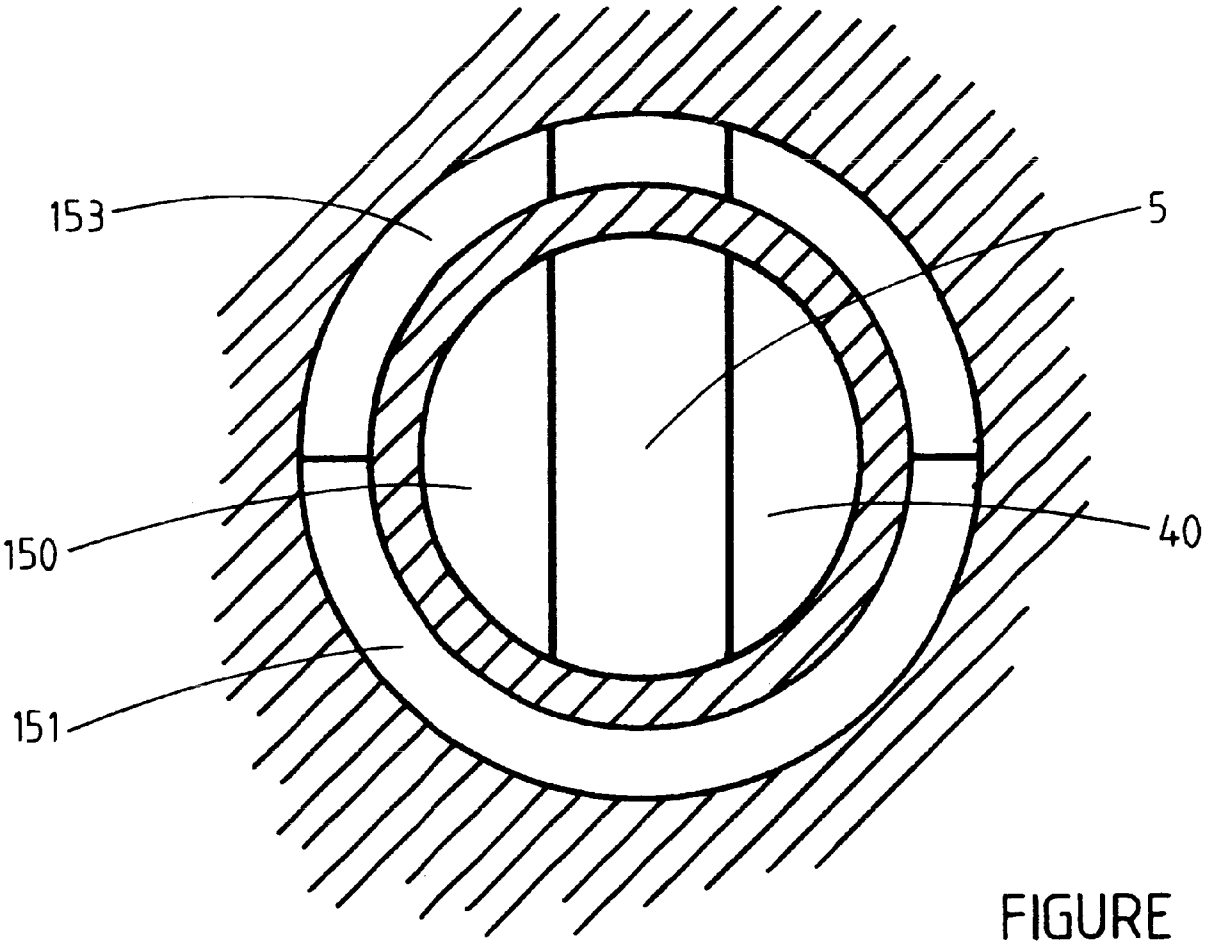
Figure 14:
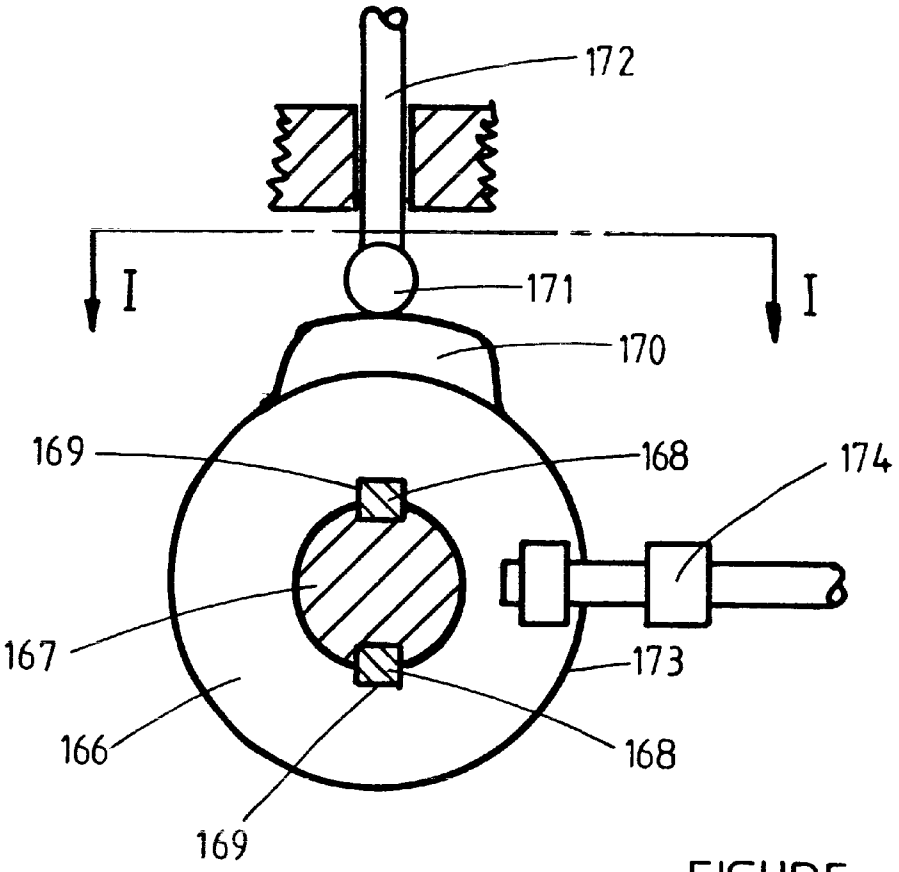
Figure 15:
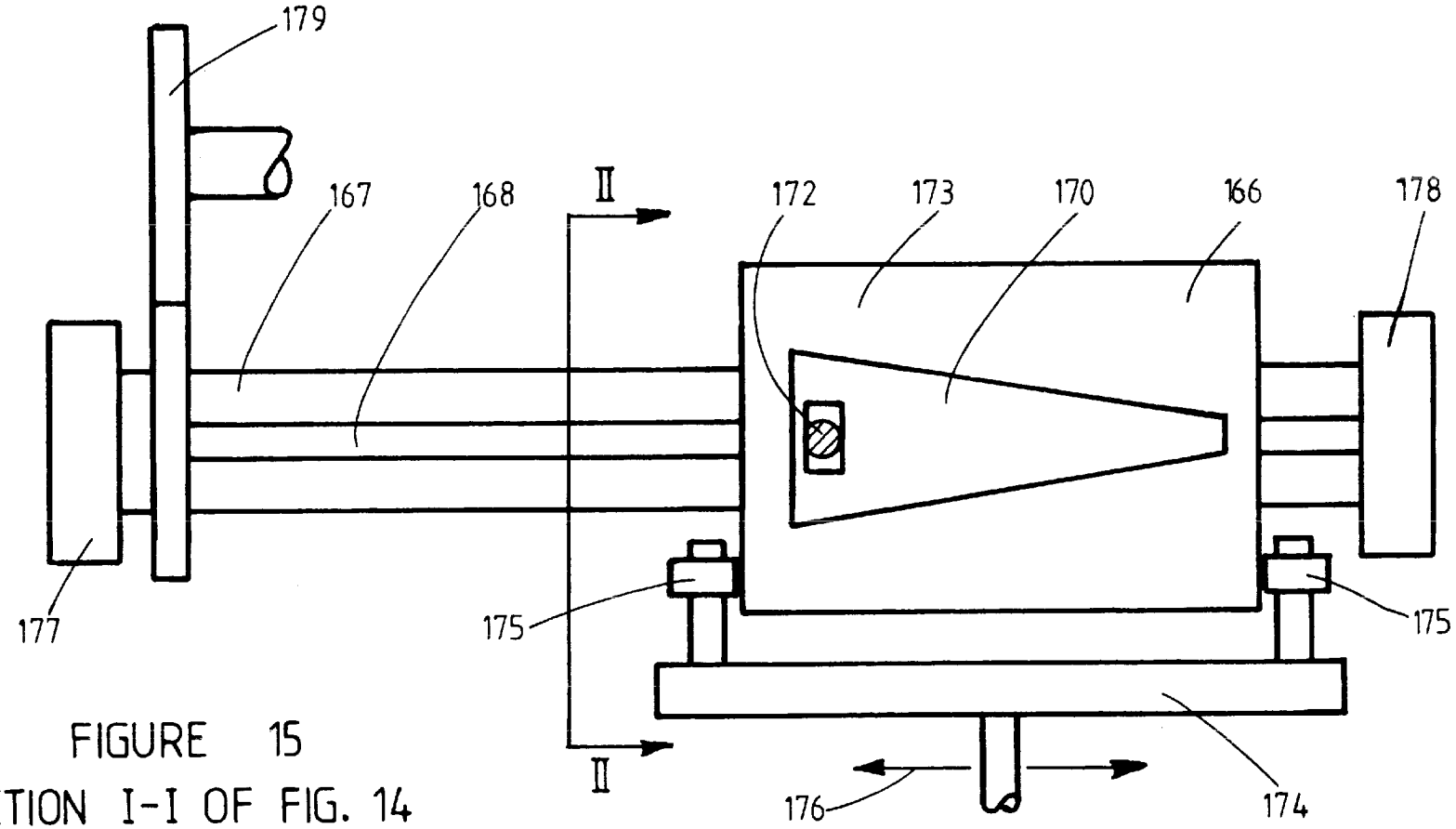

The relative positions and motions of the compressor piston and the displacer piston within the engine cylinder during a single cycle are shown schematically in time order, in FIGS. 1A, 1B, 1C, 1D, and 1E;

An example combustion chamber and fuel transfer means are shown schematically in FIGS. 2 and 4;

A pressure versus volume diagram for the cycle of a multifuel internal combustion Stirling engine of this invention is shown in FIG. 3;

Example schedules for compressor piston motion and displacer piston motion for the cycle of a multifuel internal combustion Stirling engine of this invention are shown diagrammatically in FIG. 5;

An example driver mechanism for driving the compressor piston and the displacer piston through the motion schedules of FIG. 5 is shown schematically in FIG. 6 and 7;

An air transfer valve is shown schematically in FIG. 8;

A modified displacer piston comprising a sleeve is shown schematically in FIG. 9;

An example aspirator injector for slurry fuels is shown schematically in FIG. 10;

An example air bypass adjustor for a fixed fuel bed burner is shown schematically in FIG. 11;

An example form of multifuel internal combustion Stirling engine, of this invention, is shown schematically and partially in FIG. 12, and utilizes a divided combustion chamber;

In FIG. 13 a cross sectional view of FIG. 12 shows the use of an air bypass channel as insulation for the burned gases;

A barrel cam, mechanical, controller of the air channel selector valve of FIG. 12, is shown in FIGS. 14 and 15;

(E) DESCRIPTION OF THE PREFERRED EMBODIMENTS

A. Multifuel Internal Combustion Stirling Engines Cycle

The cycle of operation, by a multifuel internal combustion Stirling engine of this invention, utilizes a compressor piston and a displacer piston, both driven to reciprocate within the same engine cylinder as shown schematically in FIGS. 1A, 1B, 1C, 1D, and 1E:

1. The compressor piston, 1, is driven via its piston rod, 2, back and forth through a fixed compressor piston stroke length, within the engine cylinder, 3;
2. The displacer piston, 4, is driven via its piston rod, 5, back and forth, within the engine cylinder, 3;
3. The engine cylinder, 3, comprises a gas cylinder head, 6, at the displacer piston end thereof, an exhaust port, 13, an intake air port, 14, an air transfer port, 17, and a burned gas port, 19;
4. The compressor piston comprises an air crown, 20, on the displacer piston side thereof; the displacer piston comprises an air crown, 21, on the compressor piston side thereof, and a gas crown, 22, on the gas cylinder head side thereof;
5. The volume, 27, between the compressor piston air crown and the displacer piston air crown is an air volume;
6. The volume, 31, between the displacer piston gas crown and the gas cylinder head is a burned gas volume;
7. The combustion chamber, 32, connects via its air inlet, 39, to the air transfer port, 17, and connects via its gas outlet, 40, to the burned gas port, 19;
8. The exhaust passage, 41, comprises an exhaust valve and actuator, 55, for opening and closing the exhaust passage;
9. As shown in FIG. 1A, the compressor piston, 1, is rising and moving toward the essentially stationary displacer piston, 4, with the exhaust passage, 41, closed, and the intake air port, 14, covered, thus compressing the air volume, 27. The burned gas volume, 31, remains essentially constant, at its minimum value greater than zero, during this compression time period;

10. As shown in FIG. 1B, the compressor piston, 1, is reversing motion direction at its top dead center, TDC, end of stroke position. The displacer piston, 4, is moving toward the compressor piston, 1, thus transferring compressed air from the air volume, 27, into the burned gas volume, 31, via the air transfer port, 17, the combustion chamber, 32, and the burned gas port, 19, the exhaust passage, 41, remaining closed during this gas transfer time period;

11. Also as shown in FIG. 1B, a fuel transfer device, 56, transfers fuel from a source, 57, into the combustion chamber, 32, during the gas transfer time period, when compressed air is being transferred from the air volume into the burned gas volume, via the combustion chamber. This resulting mixture of fuel and compressed air is ignited and burned in the combustion chamber, 32, as by compression ignition, or by a spark. It is thus burned gases, at a high temperature, which transfer into the burned gas volume, 31, during this burning time period. This gas temperature rise due to burning, increases the pressure in both the air volume, 27, and the burned gas volume, 31;

12. As shown in FIG. 1C, the compressor piston, 1, and the displacer piston, 4, are moving together, away from the gas cylinder head, 6, with a minimum air volume, 27, greater than zero, between them. During this expansion time period, the burned gas volume increases and the pressure therein decreases.

Figure 1E:
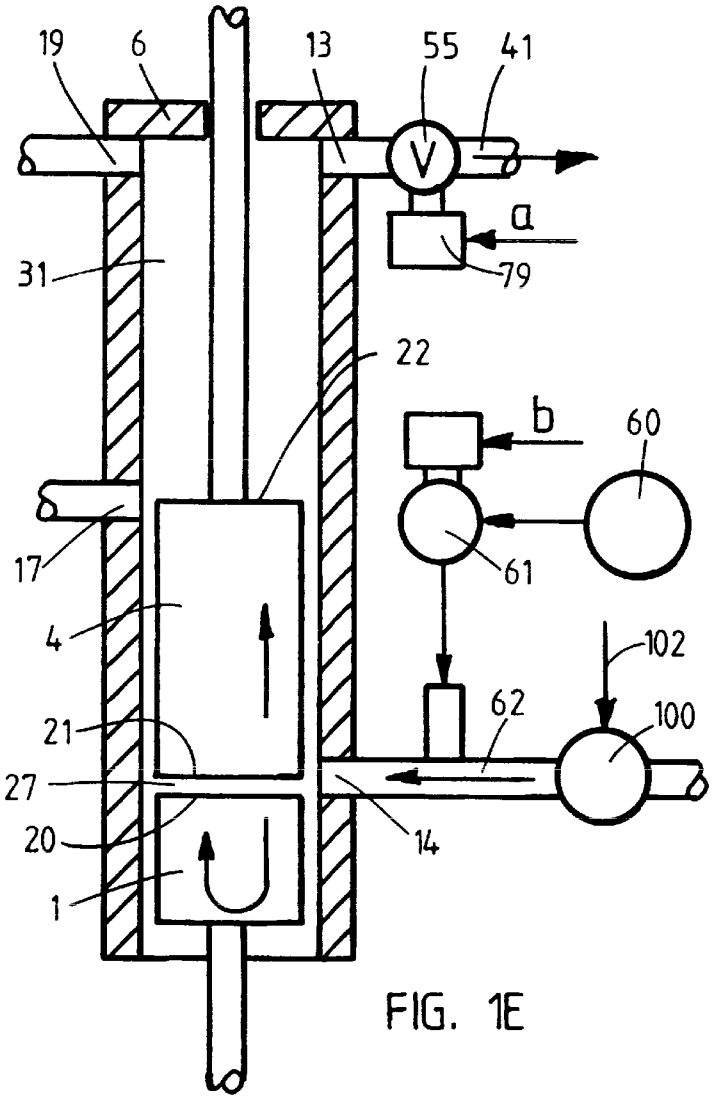
Figure 1D:
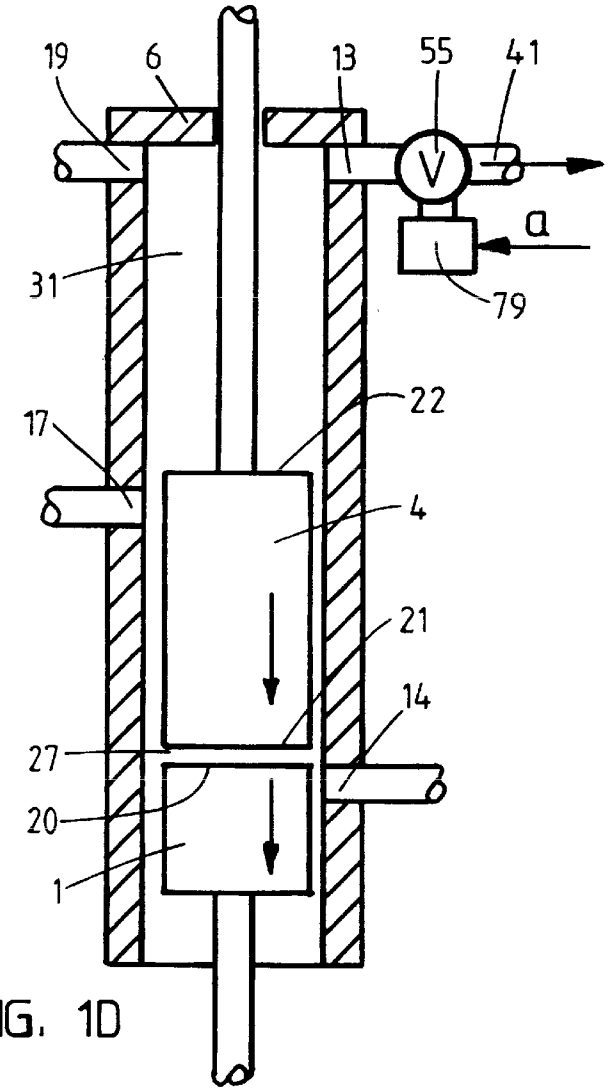

13. The exhaust passage, 41, remains closed throughout the compression time period, the gas transfer time period, and the expansion time period;

14. As shown in FIG. 1D, the expansion time period is ending when the exhaust passage, 41, is open by opening the exhaust valve, 55, and burned gases blowdown to exhaust pressure via the passage, 41. The compressor piston, 1, then uncovers the intake air port, 14, to commence addition of fresh air into the air volume, 27.

15. As shown in FIG. 1C, the scavenge time period, having started when the exhaust passage, 41, is opened for burned gas blowdown, continues while the displacer piston, 4, moves rapidly toward the gas cylinder head, 6. The engine cylinder, 3, is thus largely emptied of burned gases, and refilled with fresh air, when this scavenge time period ends, with the displacer piston again stationary, at minimum gas volume, and the compressor piston again moving toward the displacer piston, as shown in FIG. 1A. One cycle of the internal combustion Stirling engine of this invention is thus completed, and the next cycle starts thereafter;

16. So that essentially no net gas and air pressure difference acts on the displacer piston, 4, a moderate clearance space can be used between the outside diameter of the displacer piston and the inside diameter of the engine cylinder, 3.

17. A diagram of pressure in the gas and air volumes, versus total volume of the air volume, plus the burned gas volume, plus the combustion chamber volume, is shown in FIG. 3, with the diagram numbers corresponding to the FIG. 1 piston positions.

18. The pressure versus volume diagram of FIG. 3, for the cycle of a multifuel internal combustion Stirling engine of this invention, encloses a net positive work output area, since the work output of expansion between cycle points [1C] and [1D] exceeds the work input of compression between cycle points [1A] and [1B] as a result of the higher temperatures and pressures prevailing during expansion, due to occurrence of burning between cycle points [1B] and [1C]. This cycle for a multifuel internal combustion Stirling engine is essentially the same as the cycle for a two stroke cycle, conventional internal combustion engine.

19. Burned gases from combustion occupy only the burned gas volume, 31. If now the displacer piston length from air crown to gas crown is at least equal to the compressor piston stroke length, burned gases which may contain abrasive particulates, do not reach the compressor piston, 1, or that portion of the engine cylinder, 3, over which the compressor piston moves, as is seen in FIG. 1E. Thus abrasive wear of the compressor piston and cylinder liner is avoided, and hence abrasive ash forming fuels, such as coal and coke, can be economically used in a multifuel internal combustion Stirling engine of this invention. This is one of the principal beneficial objects of this invention;

20. Burned gases and abrasive particulates can reach the displacer piston, 4, and that portion of the engine cylinder, 3, over which the displacer piston moves, as also seen in FIG. 1E. But no appreciable pressure difference need exist across the displacer piston, and rubbing seals, such as piston rings, are not needed between the displacer piston and the cylinder liner, so wear is not likely to be appreciable here;

21. So that the air transfer port, 17, can remain fully open throughout the gas transfer time period, the distance between the air transfer port, 17, and the burned gas port, 19, along the engine cylinder length, is greater than the length of the displacer piston, 4, between the air and gas crowns, as can be seen in FIG. 1A, where the gas volume, 31, is at its minimum value;

22. A multifuel internal combustion Stirling engine of this invention can be operated on a gas fuel, admixed into the engine intake air during the scavenge time period, as illustrated schematically in FIG. 1E. Gas fuel from a source, 60, is transferred by a fuel transfer device, 61, into the engine intake pipe, 62, during the scavenge time period, when the intake air port, 14, is uncovered by the compressor piston, 1, and the displacer piston, 4, is moving rapidly toward the gas cylinder head, 6. During this scavenge time period the displacer piston acts to keep the intake air fuel mixture completely separated from the burned gases flowing out to exhaust. Thus no gas fuel can be wasted to exhaust during scavenge, as is a common problem with conventional, two stroke cycle, internal combustion engines. This is another beneficial object of this invention.

B. Pistons Drivers

Several different kinds of driver mechanisms can be used to move the compressor piston, 1, and the displacer piston, 4, concurrently through the power producing cycle described hereinabove. One example schedule of burned gas volume, 31, versus engine crankshaft angle, is shown in relation to corresponding compressor piston swept volume versus engine crank angle, in FIG. 5, as follows:

1. A conventional crank, connecting rod, and crosshead mechanism is assumed for this example compressor piston driver. Thus the compressor piston swept volume, on the air crown side, varies approximately sinusoidally with engine crank angle, from a zero value at compressor piston TDC and zero crank angle, to the maximum value at compressor piston BDC and 180 degrees crank angle;

2. To carry out the internal combustion Stirling engine cycle described hereinabove on FIG. 1A, 1B, 1C, 1D, and 1E, the displacer piston, 4, is to vary the burned gas volume, 31, as shown in FIG. 5. This is a rather complex motion schedule for the displacer piston, which is to move rapidly through its full stroke length, during the scavenge time period, and then remain essentially stationary during the compression time period. This complex displacer piston motion schedule can be approximated with various crank and lever combination mechanisms, but can be essentially fully followed by use of a cam mechanism to drive the displacer piston;

3. One particular example driver mechanism for driving the compressor piston, 1, and the displacer piston, 4, to carry out the internal combustion Stirling engine cycle, shown in FIGS. 1A, 1B, 1C, 1D, and 1E, and also in FIG. 5, is shown schematically in FIG. 6 and FIG. 7.

4. The compressor piston, 1, is driven from the crankshaft, 63, via the crankpin, 64, dual connecting rods, 65, 67, guided crosshead, 69, and compressor piston rod, 70, with the approximately sinusoidal motion schedule shown in FIG. 5;

5. The displacer piston, 4, is driven from the crankpin, 64, which rotates the displacer cam, 71, and moves the captured cam follower, 72, and displacer piston rod, 73, secured to the displacer piston, 4. In this FIG. 6 example driver, the displacer piston rod, 73, passes sealably through the compressor piston air crown, 74, instead of passing sealably through the gas cylinder head, 6, as shown in FIG. 1A, 1B, 1C, 1D, and 1E, in order to reach the displacer piston driver. This FIG. 7 displacer piston rod seal, within the compressor piston is not subjected to high temperature burned gases, which might contain abrasive particulates, as is the FIG. 1 seal in the gas cylinder head;

6. An example displacer cam profile is shown in FIG. 7, which can cause the displacer piston, 4, of FIG. 6, to follow the motion schedule of FIG. 5. This displacer cam, 71, is rotated in the direction, 77, about the crankshaft centerline, 75, by the crankpin, 64, with the captured cam follower, 72, moving along the line, 76. When the marked positions, 1A, 1B, 1C, 1D, and 1E, pass the cam follower motion line, 76, the displacer piston occupies the positions shown in the corresponding FIGS. 1A, 1B, 1C, 1D, 1E, and also FIG. 3;

7. The various cam radii and profiles can be estimated as follows for the FIG. 7 example cam:

$$[(ro)-(rb)] = \frac{(VAO)-(VAX)+(VCM)}{(\mathrm{AC})};\ [(ro)-(rx)] = \frac{(VAO)-(VAX)}{(\mathrm{AC})}\ [(ro)-(rc)] = [(ro)-(rx)] + \frac{(VCM)}{(2\mathrm{AC})}[1-\cos(CA)]$$

Wherein:

(rb)=Minimum cam radius to be preselected by designer;

(ro)=Maximum cam radius;

(AC)=Compressor piston area;

(VAO)=Air volume, 27, between compressor piston, 1, and displacer piston, 4, when crank angle, (CA), is 0°, with pistons positioned as shown in FIG. 1B, at the end of the compression time period;

(VAX)=Air volume, 27, between compressor piston, 1, and displacer piston, 4, during the expansion time period and approximately constant at a minimum, with pistons positioned as shown in FIGS. 1C and 1D;

(VCM)=Swept volume of the compressor piston, 1;

(CA)=Engine crank angle, measured from compressor piston at top dead center, TDC, at zero degrees (CA) as shown in FIG. 5;

(rx)=Cam radius at end of gas transfer time period with pistons positioned as shown in FIG. 1C;

(rc)=Variable cam radius, during the expansion period between points 1C and 1D;

The swept volume (VCM) of the compressor piston, can be estimated by usual methods, from the intended engine torque output per cylinder, the volumetric efficiency, and hence the needed air quantity per cycle. The air volume (VAO), between compressor and displacer pistons, at the end of the compression time period, can be estimated from the intended engine compression ratio (CR) and hence cycle efficiency as follows:

$$(CR) = 1 + \frac{(VCM)}{(VCL)}$$

(VCL)=Total clearance volume at end of compression process;

(VCL)=(VBO)+(VAO)+(VFM)

(VBO)=Minimum needed clearance volume of the burned gas volume, 31, as shown in FIG. 1A;

(VFM)=Internal volume of the combustion chamber, 32. Any consistent system of units can be used in these approximate relations. The cam profile for the expansion time period between points 1C and 1D, as defined by these relations, causes the displacer piston to follow closely the compressor piston during expansion, with a minimum required clearance volume (VAX) between the pistons.

The cam profiles for the gas transfer time period between points 1B and 1C, preceding the expansion time period, can be any of various profiles, such as a linear profile with suitable acceleration and deceleration ramps at the start and end.

Similarly, the cam profile for the scavenge time period between points 1D, 1E, and 1A, following next after the expansion time period, can be any of various profiles, such as a linear profile with suitable acceleration and deceleration ramps at the start and end. This scavenge period cam profile is intended to rapidly move the displacer piston through its full stroke length, between the end of blowdown, as shown on FIG. 1E, and the start of compression as shown on FIG. 1A, and will preferably be a rather steep cam profile. The acceleration force, acting between the cam, 71, and the captured cam follower, 72, will thus be large during this scavenge time period, but can be kept reasonable by use of a hollow displacer piston.

During the compression time period, next following after the scavenge time period, the displacer piston remains essentially stationary and the cam profile between points 1A and 1B has a constant radius of ro.

A roller cam follower with return spring can be used instead of the captured cam follower shown in FIG. 6.

Other driver mechanisms can be used to move the compressor piston and the displacer piston through an internal combustion Stirling engine cycle. The Rhombic driver mechanism, widely used in prior art external combustion, Stirling cycle engines, can create piston motion patterns approximately like those shown in FIG. 5, but the scavenge time period motion will be slow, resulting in reduced engine volumetric efficiency, and consequently increased engine size and weight for the same power output.

8. The desired rapid displacer piston motion during the scavenge time period, followed by a stationary displacer piston during the compression time period, and with displacer piston motion closely following the compressor piston during expansion, can be achieved with a quick return mechanism, such as are used in machine shop shapers, with the addition thereto of two, separate, cam actuated, motion compensator mechanisms as follows:
   a. An example quick return mechanism is described in the reference, *"Elements of Mechanism,"* P. Schwamb, A. Merrill, W. James, $4^{th}$ edition, 1931, John Wiley, New York, on pages 265 through 268, and FIGS. 340 and 341, and this material is incorporated herein by reference thereto;
   b. A cam actuated collapsing link mechanism is substituted for the final drive linkage, H, on FIGS. 340 and 341, which changes length during the compression time interval, to offset the motion of the swinging arm, CN, and thus hold the displacer piston stationary. After the compression time interval the collapsing link is held fixed at full length during the following expansion time interval;
   c. The radius of the pin, A, on the rotating crank, BA, is made adjustable by tracking a stationary cam, which by shortening the radius, slows down the speed of the swinging arm, CN, during the first part of the expansion time interval, so that the displacer piston will not overtake the then slow moving compressor piston. After the expansion time interval the radius of the pin, A, is held fixed;
   d. In this way this double compensated, quick return mechanism can create the desired displacer piston motion shown in FIG. 5 herein. However, this mechanism is more complex, and probably more costly, than the captured cam displacer piston driver described hereinabove;

C. Valves and Drivers and Misc.

1. The exhaust valve, 55, can be driven by a conventional mechanical cam, cam follower, push rod, rocker arm mechanism, as commonly used on prior art internal combustion engines. Alternatively, the valve actuator, 79, can comprise: a hydraulic or pneumatic pressure source, with solenoid piloted valve; controlled via an electronic controller, 90; responsive to an engine crank angle and speed sensor, 91; as shown on FIGS. 1D, 1E, and 6. An advantage of the electronic controlled valve driver over the mechanical valve driver, is that exhaust valve opening can be adjusted to open earlier during expansion as engine speed increases, in order to allow sufficient time for exhaust blowdown.
2. The electronic controller, 90, can also function to control the gas fuel transfer device, 61, shown in FIG. 1E, so that gas fuel is only transferred into the engine intake pipe, 62, during the scavenge time period when the air intake port, 14, is uncovered by the compressor piston, 1;
3. Similarly the electronic controller, 90, can also function to control the fuel transfer device, 56, as for a liquid or slurry fuel, shown in FIG. 1B and FIG. 9, so that fuel is only transferred into the combustion chamber, 32, during the gas transfer time period, when compressed air is being transferred from the air volume, 27, into the combustion chamber, 32;
4. Where spark ignition is used to initiate the combustion process, the electronic controller, 90, can additionally comprise the needed high voltage igniter to supply ignition energy to a spark plug, 92, as shown on FIG. 8, during the burning time period;
5. An air transfer valve, 93, is shown in FIG. 8, interposed between the air transfer port, 17, and the burned gas port, 19, of the cylinder, 3. This air transfer valve can function to prevent backflow of burned gases into the air volume, 27, during scavenge, for those engines whose exhaust back pressure is high. This air transfer valve could be a check valve, driven by the pressure difference between the gas chamber, 31, and the air chamber, 27. Alternatively this air transfer valve could be driven via the electronic controller, 90, in the same way that the exhaust valve, 55, is driven, as described hereinabove, except that the air transfer valve is only closed during the scavenge time period;
6. In FIG. 8, the combustion chamber, 32, is shown in an alternative position, as a portion of the burned gas volume, 31, with fuel being injected thereinto via an injector nozzle, 94, from the fuel transfer device, 56. This arrangement may be preferred when higher engine compression ratios are to be used;
7. To assure equalization of the pressures acting on the two crowns, 21, 22, of the displacer piston, 4, the outside diameter of the displacer piston and the inside diameter of that portion of the cylinder, 3, between the top of the air transfer port, 17, and the gas cylinder head, 6, can be slightly smaller than the outside diameter of the compressor piston, 1, and the inside diameter of the remaining portion of the cylinder, 3, as shown in FIG. 8. A passage, 99, is thus created between the air volume, 27, and the air transfer port, 17, during the expansion time period, when the air transfer port, 17, might otherwise be covered by the displacer piston, 4.

D. Fuels and Burners

Many different kinds of fuels can be used in a multifuel internal combustion Stirling engine of this invention as illustrated by the following examples:

1. Liquid fuels, such as diesel fuel can be injected into the combustion chamber, 33, as shown in FIG. 1B, during the gas transfer time period. Any of several prior art diesel fuel injection systems can be used, which control both the time of injection and the fuel quantity injected per engine cycle as a method for engine torque control. In some applications it may be preferred that liquid fuel injection and compressed air transfer occur concurrently, so that essentially each transferred air mass contains a portion of the fuel, and each injected fuel mass is surrounded by a portion of the transferred air. Combustion can be initiated by an electric spark, positioned beyond the fuel injector in the direction of air transfer motion during the burning time period. A smooth and quiet combustion process can be obtained in this way.
2. Gas fuels, such as natural gas, can be injected into the engine intake pipe, 62, as shown in FIG. 1E, during the scavenge time period. Any of several prior art gas fuel injection systems, 61, can be used in combination with an engine air quantity control, 100, such as an intake throttle, or an adjustable supercharger. To control engine torque, both gas fuel quantity and engine air quantity need to be adjusted together to maintain an ignitable mixture ratio. During the gas transfer time interval, this premixed gas fuel in air mixture can be ignited by an electric spark, positioned at entry to the combustion chamber. To avoid flashback of the ignited flame into the air chamber, a flame arrester screen can be placed between the air chamber and the electric spark plug. Alternatively, a portion of the air transfer passage at combustion chamber entry, can have a flow area, sufficiently reduced, that flow velocity of the gas fuel in air mixture therethrough exceeds the flame speed of the mixture.

3. Slurry fuels, such as coal water slurry, can alternatively be aspirated into the compressed air being transferred into the combustion chamber, 32, during the gas transfer time period. The compressed air flows through a reduced area aspirator section, and the resulting pressure drop forces a slurry fuel quantity, metered in proportion to engine torque, to flow out of an enclosed fuel cavity into the flowing air quantity, and hence into the combustion chamber. A description of an example slurry fuel aspirator injector is presented in my U.S. Pat. No. 5,931,123, issued Aug. 3, 1999, and this description is incorporated herein by reference thereto. This slurry fuel aspirator could be placed at the entry, 101, of the combustion chamber, 32, shown in FIG. 1B, or at the entry, 94, of the combustion chamber, 32, shown in FIG. 8. In this slurry aspirator injector, slurry velocities and pressures can be rather low, and aspirator injector wear consequently is not the problem it has been for conventional diesel type injectors, used for slurry fuels. When injecting slurry fuels via an aspirator injector, with an internal combustion Stirling engine of this invention, any abrasive particulates need not contact the compressor piston and cylinder portion, and piston and cylinder wear are thus avoided. This is a particular advantage of this invention over the engine described in my U.S. Pat. No. 5,931,123, wherein abrasive particulates are in contact with the engine piston and cylinder and will cause aggravated wear there. A coal water slurry wherein the coal contains sufficient suitable volatile matter, may be spark ignited when mixed with air, as described above.

An example coal in water slurry (CWS) fuel aspirator is shown schematically in FIG. 10 and comprises the following elements:

a. A portion of the combustion chamber, 32, comprises a reduced area venturi throat section, 106, through which the compressed air flows from the air chamber, 27, to the burned gas chamber, 31, during the gas transfer time period;

b. Coal in water slurry fuel, from a supply, 112, is delivered into the fuel cavity, 113, by the timed metering pump, 114, preferably timed to deliver the fuel quantity per engine cycle (MF), during the scavenge time period when pressures are low, and in any case timed to deliver this fuel quantity prior to the start of the gas transfer time period;

c. The fuel quantity (MF) per engine cycle is adjusted by the metering pump, 114, in proportion to an engine torque input, 115; the fuel metering pump, 114, can be driven directly from the engine crankshaft;

d. The check valve, 116, or other unidirectional flow device, prevents back flow of fuel from the fuel cavity, 113, when pressure in the combustion chamber, 32, is high during the compression, burning, and expansion time periods;

e. As compressed air is accelerated through the reduced area venturi section, 106, its velocity there increases, and the pressure decreases. Thus the fuel quantity in the fuel cavity, 113, is forced out of the cavity via the fuel discharge line, 117, and fuel timing orifice, 120, into the high velocity reduced pressure compressed air, flowing through the venturi section, during the gas transfer time period, by the higher upstream pressure from the pressure connection, 119.

f. The fuel timing orifice, 120, is sized to fully transfer the maximum fuel quantity per cycle, MF, at maximum torque, during each gas transfer time interval; The fuel discharge line, 117, reaches essentially to the bottom of the fuel cavity, 113, so that all of the fuel quantity, placed in the cavity by the metering pump, 114, is essentially fully discharged into the compressed air quantity, undergoing concurrent transfer, through the combustion chamber, 32;

g. The coal in water slurry fuel will be atomized into small droplets by the atomizing forces created in the venturi section, 106; These atomizing forces are due to the high velocity of the compressed air through the venturi section, 106, and the high velocity of the fuel through the timing orifice, 120, and these velocities increase as engine RPM increases; A suspension of atomized slurry fuel in compressed air is thus created by this aspirator fuel transfer means.

h. As engine RPM decreases, compressed air velocity through the venturi, and fuel velocity through the orifice, decrease, while the time duration of the gas transfer time interval increases; Thus, for air velocities well below sonic velocity, the slurry fuel aspirator, shown in FIG. 10, is approximately self compensating over a range of engine speed; However, as engine RPM decreases, the atomizing forces also decrease, and the slurry droplets become larger;

i. For engines operating over a very wide range of speed it may be preferred to reduce the area of the venturi throat, 106, as engine RPM decreases, so that the atomizing forces remain high at all engine speeds. The flow area of the venturi throat, 106, can be made adjustable, by moving the wedge shaped area adjustor, 107, in the direction, 111, as by use of a threaded adjustor rod, 109, and nut rotated by a stepper motor, 110. Other venturi area adjustment schemes can also be used, as are well known in the art of adjustable throat carburetors;

j. The pressure drop into the venturi throat, 106, can be largely recovered in the pressure recovery zone, 121, where flow area increases in the flow direction, provided venturi throat velocities are subsonic;

k. Preliminary sizing of a slurry fuel aspirator, such as the example shown in FIG. 10, can be carried out by use of the following approximate relations:

$$(AV) = (AD)(0.748)(RPM)\frac{\frac{\sqrt{R(TC)}}{(pc)}[ro) - (rx)]}{(CAC^{\circ})}\frac{1}{[f)]};\ \text{ft.}^2$$

$$(VFC) = \frac{(0.73)(12n+m)(EQR)(MA)}{(Wt.\ \%\ \text{coal in}\ CWS)\left(n+\frac{m}{4}\right)(df)} = \frac{(MF)}{(df)};\ \text{ft.}^3$$

$$(AF) = \frac{(VFC)(0.745)(RPM)\left(\sqrt{(df)}\right)}{(CAC^{\circ})CF)\left(\sqrt{\Delta p}\right)}$$

Wherein:

(VFC)=Minimum volume of fuel cavity, 113, cubic feet;

(AV)=Venturi throat area, 106, square ft.;

(AF)=Fuel orifice area, 120, square ft.;

(AD)=Displacer piston area, square ft.;

(RPM)=Engine revolutions per minute;

$$R) = \text{Gas constant for air} = 53.3, \frac{\text{ft lbs}}{\text{lbsm} \times {}^{\circ}\text{R}}$$

(TC)=Compressed air temperature at end of compression time period, degrees Rankine;

(ro)=Outer radius of displacer driver cam, feet;

(rx)=Radius of displacer driver cam at end of gas transfer time period, feet;

$$[(ro) - (rx)] = \frac{(VAO) - (VAX)}{(AD)}$$

(PC)=Compressed air pressure at end of compression time period, pounds per square foot absolute;

(CAC°)=Crank angle degrees duration of the gas transfer time period;

$$f(r) = \sqrt{\left(\frac{K}{K-1}\right)\left[\left(\frac{P_2}{P_c}\right)^{2/K} - \left(\frac{P_2}{P_c}\right)^{K+1/K}\right]}$$

k=Approximately 1.4 for air;

(p2)=Air pressure in the venturi throat, 106, in pounds per square foot absolute;

(MA)=Engine air mass per cycle, pounds;

n=Mols carbon per 100 pounds of coal;

m=Mols hydrogen per 100 pounds of coal;

[wt % coal in CWS]=Weight percent coal in the coal in water slurry;

(EQR)=Equivalence ratio of coal to air, actual mass ratio of coal to air, divided by stoichiometric mass ratio of coal to air; usually less than 1.0;

(df)=Density of coal in water slurry, pounds per cubic foot;

(Cf)=Fuel timing orifice, 120, flow coefficient;

(Δp)=Pressure difference across the fuel timing orifice, in pounds per square foot;

(Δp)=[(Pc)−(p2)]

The engine speed, displacement, compression ratio, etc. supply most of the values for aspirator sizing. The designer can preselect values for the duration of the gas transfer time period, (CAC°) and the pressure drop into the venturi throat, (Δp). Higher values of venturi pressure drop yield finer atomization of the coal-in-water slurry, but can create an increased loss due to incomplete pressure recovery in the zone, 121.

The minimum volume of the fuel cavity, 113, is to at least equal the maximum volume of the fuel quantity per engine cycle (MF);

1. Prior art coal in water slurry fuel injectors can alternatively be used in a multifuel internal combustion Stirling engine of this invention. These prior art slurry fuel injectors utilize a very high fuel injection pressure, in order to obtain adequate atomization of the slurry fuel. A result of these high injection pressures and consequent slurry velocities, is a high wear rate of the fuel injector nozzle. An aspirator slurry fuel injector, such as the example illustrated in FIG. 10, can utilize much lower slurry injection pressures, since adequate atomization results as much from the high air velocities through the venturi throat, as from the slurry fuel injection velocity. Hence slurry fuel injection nozzle wear is greatly reduced. This is a particular advantage of aspirator slurry fuel injectors over prior art slurry fuel injectors.

m. Other types of slurry fuels can be used in aspirator slurry fuel injectors, such as coal in diesel fuel slurries and residual petroleum fuel in water slurries, as described in my cross referenced US Patent application entitled, "Steam Driven Fuel Slurrifier."

n. A pilot fuel injector, 123, can be supplied with pilot igniter fuel, from a source, 124, via a timed pump, 125, so that igniter fuel is injected into the combustion chamber, 32, during the combustion time period, and ignited by an electric spark, via the spark electrodes, 126. The resulting pilot igniter flame intersects the spray of slurry fuel in compressed air, and functions, first to evaporate the water portion of the slurry, and second to ignite the thusly dried coal particles. Burning of the coal particles thus takes place in the combustion chamber, 32, downstream from the pilot fuel injector, 123, during the burning time period. Various kinds of readily spark ignitable fuels can be used as pilot igniter fuel, such as diesel fuel or natural gas. The igniter fuel pump, 125, can be driven directly from the engine crankshaft, and timed to inject pilot igniter fuel, at high pressure, during the burning time period. A constant igniter fuel quantity can be used, or this quantity can be varied in proportion to the slurry fuel quantity. For a coal in water slurry fuel, comprising about 50 weight percent coal, the igniter fuel quantity is preferably at least 2 to 3 weight percent of the slurry fuel, for a hydrocarbon igniter fuel. This igniter fuel quantity supplies at least enough energy to evaporate the water from the slurry. Timed electric spark energy can be delivered to the igniter spark electrodes, 126, from the electronic controller, 90, of FIG. 7, responsive to the engine crank angle sensor, 91, during the burning time period. A smooth and steady burning of the slurry fuel can be achieved by use of a spark ignited pilot fuel igniter.

o. Engine torque control, as by hand or by a governor, can act directly on the fuel transfer devices, 56 or 61, or indirectly via the electronic controller, 90, via a torque input, 102, thereinto.

p. Coal or coke solid fuel, in chunk form, can also be used in a multifuel internal combustion Stirling engine of this invention by locating a fuel bed holder inside the combustion chamber, 32, and transferring chunk fuel thereon, to maintain a fixed fuel bed of solid fuel through which all, or an adjustable portion of the compressed air, being transferred into the combustion chamber during the gas transfer time period, would pass. One particular example form of such a fixed fuel bed reactor for solid chunk fuels is described in my U.S. Pat. No. 5479893, issued Jan. 2, 1996, and this description is incorporated herein by reference thereto. This reference also describes example solid chunk fuel transfer apparatus and example ash removal apparatus. Additional example solids transfer mechanisms are described in my U.S. Pat. No. 5,613,626, issued Mar. 25, 1997, and this material is also incorporated herein by reference thereto. This example fixed bed reactor for solid chunk fuels can be briefly described by referring to FIG. 2 and FIG. 4, reproduced here from U.S. Pat.No. 5,479,893.

i. The tapered combustion chamber, 8, comprises several air ports, 24, distributed around and along the length of the chamber, and connected to an air manifold, 25, which connects in turn to the air transfer port, 17, of the engine cylinder, 3, of FIG. 1. Burned gases leave the combustion chamber, 8, via the exit ports, 28, and burned gas manifold, 29, which connects to the burned gas port, 19, of the engine cylinder, 3, of FIG. 1.

ii. Solid chunk fuel, preferably admixed with inert ceramic chips, is steadily forced into the combustion chamber, 8, by the refuel piston, 35, driven by the refuel driver piston 37, with air volume pressure acting in the refuel driver chamber, 136. When the refuel piston, 35, reaches the end of its stroke, it initiates its own retraction via the switch, 58, and retraction controller, 59. The supply plate, 33, with a fresh charge of solid fuel and ceramic chips from the fuel source hopper, 66, is moved into line with the retracted refuel piston, 35, and air volume pressure is then again applied to the refuel driver chamber, 136, to commence the next refuel interval. As the solid fuel is burned inside the combustion chamber, 8, it is continuously replaced by this refuel transfer mechanism. The ashes and inert ceramic chips collect in the ash cavity, 43, in the ash removal plate, 42, and are periodically removed by sliding the ash plate so that the cavity, 43, is aligned with the ash ram, 49, which discharges the ashes and ceramic chips via the hopper, 50.

iii. A more detailed description of the operation of this solid chunk fuel reactor is presented in the referenced U.S. Pat. No. 5,479,893. An alternative ash removal mechanism is described in detail in the referenced U.S. Pat. No. 5,613,626.

iv. Torque output of a solid chunk fueled internal combustion Stirling engine can be controlled by controlling engine intake air density with a throttle or adjustable supercharger, 102, 100. Alternatively, an adjustable air bypass channel can be added between the air manifold, 25, and the burned gas manifold, 29, of the solid fuel reactor shown in FIG. 2. To reduce engine torque output, a larger portion of the compressed air being transferred into the combustion chamber during the gas transfer time interval, can bypass the fixed fuel bed, and in consequence less fuel will be reacted during each engine cycle, thus reducing torque output;

v. During startup of a multifuel internal combustion Stirling engine, using a solid fuel in chunk form, the fixed fuel bed must be preheated up to its rapid reaction temperature. One example scheme for this preheater is to interpose a gas fuel burner or liquid fuel burner, 101, as described hereinabove, between the air transfer port, 17, and the fixed fuel bed reaction chamber, 8, as shown in FIG. 1B. The hot burned gases from the gas or liquid fuel burner will preheat the solid chunk fuel while passing through the fixed bed reactor, 8; this scheme also creates an internal combustion Stirling engine capable of operating on either a solid chunk fuel or a gas or liquid fuel.

E. Modified Elements

1. By adding a ported sleeve, 103, to the displacer piston, 4, and modifying the gas cylinder head, 6, to comprise a sleeve recess, 104, as shown on FIG. 9, a larger portion of the engine cylinder surface, 3, can be sheltered from contact with abrasive particulates in the burned gases, within the gas volume, 31. Slotted ports, 105, in the sleeve, 103, aligned with the burned gas port, 19, and the exhaust port, 13, assure that these ports remain open to the gas volume, 31. The sleeve recess length at least equals approximately the sleeve, 103, length beyond the displacer piston gas crown, 22.

2. Insulating material such as a high temperature ceramic, can be beneficially placed on the burned gas surfaces of the combustion chamber, 32, and the gas volume, 31, to reduce heat transfer losses into the engine cooling jacket, and thus increase the fuel efficiency of the engine. Use of such insulating material in prior art internal combustion engines yielded significant fuel efficiency improvements, but cyclic thermal expansion stresses caused early fatigue failure of the ceramic insulating material. In prior art internal combustion engines, the ceramic insulation is subjected to very hot gases, circa 4000° F., followed by cold intake air, circa 100° F., during each cycle, and the resulting cyclic thermal expansion stresses lead to early fatigue failure of the ceramic. In a multifuel internal combustion Stirling engine of this invention, ceramic insulation on the gas volume and the combustion chamber is subjected to a much smaller gas temperature range, circa 4000° to 1500° F., since cold intake air does not reach these volumes. As a result, cyclic thermal expansion stresses are much smaller. Hence this ceramic insulation will have an appreciably longer fatigue life in a multifuel internal combustion Stirling engine of this invention than a prior art internal combustion engine. This is another beneficial object of this invention.

F. Comparison to External Combustion Stirling Cycle

The original external combustion Stirling cycle engines enjoyed a reasonable market success for many years when the piston steam engines were the competition, but became obsolete when more efficient and compact internal combustion engines were developed. Recent external combustion Stirling cycle engines have achieved efficiencies and sizes competitive with prior art internal combustion engines as follows:

1. A hydrogen or helium working fluid, at very high pressure, was used and was essentially fully retained inside the engine cylinder throughout the useful life of the engine. This retention of high pressure gas required the development of special seals for the pistons and piston rods, which were expensive and required frequent replacement.

2. To achieve the high working fluid temperatures needed for competitive efficiencies, required the use of special superalloy materials in the heat exchanger, between the external combustion chamber and the internal working fluid, and these superalloy materials are scarce, expensive and difficult to process.

3. These cost problems with current external combustion Stirling cycle engines have prevented their wide replacement of prior art internal combustion engines, even though these Stirling cycle engines can efficiently utilize a wide variety of fuels, including low cost coal or coke.

4. It is another beneficial object of the multifuel internal combustion Stirling engines of this invention that these low cost solid fuels, such as coal and coke, can be efficiently utilized in an engine that does not require special seals, since the working fluid is discarded for each cycle, and which does not require costly materials, since energy is added to the working fluid by combustion therein, rather than by heat transfer.

G. Divided Combustion Chamber

To achieve best fuel efficiency, for an internal combustion engine, the burning of fuel and air is to take place when cylinder pressures are high and this potential burning time interval thus commences late during the compression time interval; extends through the gas transfer time period, and ends during the early portions of the expansion time interval. The actual burning time period, when fuel and air are present together, are ignited and burned to burned gases, can take place during all, or only a portion, of this potential burning time interval.

For some types of engine fuel, such as solid fuel in chunks, on a fixed fuel bed holder, as shown, for example in FIG. 2, fuel burnup per engine cycle, and hence engine torque, can be controlled by using a divided combustion chamber, as follows:

(a) The combustion chamber comprises two separate air flow channels: a burner channel, and an air bypass channel;

(b) The fixed fuel bed holder is inside the burner channel, so that all air, flowing through the burner channel, flows also through the fixed fuel bedholder;

(c) Air flowing through the bypass channel does not flow through the fixed fuel bed;

(d) The fuel burned per engine cycle, and thus the engine torque, can be controlled by controlling the proportion of the total air being transferred, during the gas transfer time interval, which passes through the burner channel;

(e) An air flow channel diverter valve can be used to adjust the proportion of the air being transferred which passes through the burner channel, during each gas transfer time interval. One particular example adjustable air bypass channel, for torque control, is shown schematically in FIG. 11, and comprises: a diverter valve with blade, 181, and blade shaft, 180, interposed between the burner air channel, 150, and the bypass air channel, 151, so that air being transferred, during the gas transfer time period, flows concurrently through both channels, the relative air flow proportions being adjusted by adjusting the diverter valve blade, 181, position via the blade shaft, 180. At maximum torque, all air can be diverted to flow through the burner air channel, 150, and hence also through the fixed fuel bed reactor, 152, and maximum solid fuel burnup per cycle will occur, yielding maximum torque. At engine stopping, all air can be diverted to flow through the bypass air channel, 151, and the engine will stop, since little or no fuel burnup occurs. The torque control can act directly upon the diverter valve blade shaft, 180, or indirectly via a shaft actuator, 182, energized from the electronic controller, 156, responsive to an engine torque input, 157.

(f) Alternatively an air flow channel selector valve, and actuator with controller, can be used to control the duration of air flow through the burner channel, as a proportion of the potential burning time interval, during each engine cycle. A longer duration through the burner channel, increases the fuel burned per engine cycle, and hence the engine torque. The air flow channel selector valve is always open to one of the two separate air flow channels, one at a time, throughout at least the compression time interval, the gas transfer time interval, and the expansion time interval;

An example scheme for thusly adjusting the duration of air flow through the burner channel, as a proportion of the potential burning time interval, is shown in FIG. 12 and FIG. 13, and comprises:

(1) The combustion chamber, 32, comprises two separate air flow channels, a burner channel, 150, and an air bypass channel, 151;

(2) The fixed fuel bed holder, 152, such as the example shown in FIG. 2, is inside the burner channel, 150, so that all air flowing through the burner channel, flows also through the fixed fuel bed;

(3) Air flowing through the bypass channel, 151, bypasses the fixed fuel bed, 152, and flows around the outside of the burned gas outlet, 40, as shown in FIG. 13, and directly into the burned gas volume, 31, via the port, 153;

(4) An air channel selector valve,154, with actuator, 155, and controller, 156, controls into which air flow channel, the air being transferred from the air volume, 27, into the burned gas volume, 31, flows during the gas transfer time interval; as shown in FIG. 12, air is being directed only into the burner channel, 150, and no air is flowing through the bypass channel, 151;

(5) The example electronic controller, 156, shown in FIG. 12, responds to an engine torque input, 157, from an engine torque regulator, an engine crank angle input, 158, and an engine speed input, 159, from an engine crank angle and speed sensor, 91, such as shown in FIG. 6. The electronic controller operates upon the solenoid actuator, 155, of the air channel selector valve, 154, to increase the proportion of the gas transfer time interval, during which air transfers through the burner channel, 150, as engine torque is to be increased. The increased air quantity thus flowing through the burner channel, and the fixed bed of fuel, causes an increased fuel burnup per engine cycle, and thus an increased engine torque.

(6) The air channel selector valve, 154, shown in FIG. 12, is controlled by the controller, 156, to be open to either the burner channel, 150, or the bypass channel, 151, throughout at least the compression time interval, the gas transfer time interval, and the expansion time interval. The air channel selector valve, 154, can additionally remain open during the scavenge time interval, as, for example, when an air transfer valve, 93, is used in the air inlet passage, 39, to prevent backflow of burned gas during the scavenge time period. Alternatively, these functions of the air channel selector valve, 154, and the air transfer valve, 93, can be combined into a single valve with actuator and controller;

(7) Where a solid fuel in chunks, such as coal or coke, is to be the running engine fuel, it must be preheated, at startup, to a temperature at which it will react rapidly with the air being transferred through the burner channel. A gas fuel supply, 160, and high pressure injector, 161, with spark igniter, 162, placed in the burner channel, 150, upstream from the fixed fuel bed, 152, can be used for this solid fuel preheater. A gas fuel pump, 163, pumps gas from the supply, 160, into a common rail, 164, which supplies high pressure gas fuel to all gas fuel injectors, 161, during each burning time interval, when the engine is being started. The gas fuel thusly injected into the burner channel, 150, mixed with the air flowing therethrough, and the resulting air and gas fuel mixture is ignited by the spark, 162, and burns to form hot burned gases, which preheat the solid fuel while passing through the fixed fuel bed, 152. The back pressure control valve, 165, maintains an approximately constant pressure in the common rail, 164, sufficiently higher than the compression pressures in the burner channel, that gas fuel injection can occur during each burning time interval. The controller, 156, controls the opening of the gas fuel injector, 161, to occur only when air is flowing through the burner channel, 150, during the gas transfer time interval. Alternatively, the pressure in the common rail, 164 can be controlled by control of the pumping rate of the gas fuel pump, 163, instead of using a back pressure valve, 165.

(8) After the solid fuel in the fixed bed becomes hot enough to react readily with the air passing through the burner channel, the gas fuel preheater scheme can be turned off;

(9) In a similar way a diesel fuel supply, and high pressure injection system, can be used alternatively, as the solid fuel preheater scheme;

(10) A multifuel internal combustion Stirling engine of this invention can operate wholly on a gas fuel injection system, or a diesel fuel injection system, such as these preheater schemes, when no solid fuel is supplied, or when the fixed solid fuel bed holder system is not used on the engine. The ratio of gas fuel, or diesel fuel, to air flow in the burner channel; can be essentially constant at the best valve, torque being controlled by adjusting the duration of concurrent flow of fuel and air into the burner channel during the burning time interval.

A mechanical controller of the air channel selector valve, 154, can be substituted for the electronic controller, 156, shown on FIG. 12 and described hereinabove. One example of such a mechanical controller is shown on FIG. 14 and FIG. 15 and comprises the following:

(11) The barrel cam, 166, is driven at engine crankshaft speed via the shaft, 167, and keys, 168, and sliding keyways, 169;

(12) The lifted section, 170, of the barrel cam, 166, acts via the barrel cam follower, 171, and push rod, 172, to open the air channel selector valve, 154, only to the burner channel, 150;

(13) The base circle, 173, of the barrel cam, 166, acts via the cam follower and push rod, 172, to open the air channel selector valve, 154, only to the bypass channel; 151;

(14) The lifted cam section, 170, is timed to thusly open air flow into the burner channel, 150, during all, or a portion, of the gas transfer time interval.

(15) The duration of air flow through the burner channel, and thus the duration of the burning time interval, as a proportion of the potential burning time interval, is set by the angular width of the lifted section, 170, of the barrel cam, 166, acting on the cam follower, 171. This width varies along the length of the barrel cam as shown on FIG. 15;

(16) The barrel cam, 166, is moveable along the length of the shaft, 167, by the torque control bracket, 174, with roller followers, 175, which act on the ends of the barrel cam;

(17) As shown on FIG. 15, the maximum width lifted section, 170, is acting on the cam follower, 171, and the duration of air flow through the burner channel, and hence the fuel quantity burned per engine cycle, and thus the engine torque, are a maximum. Sliding the barrel cam, 166, in the direction, 176, via the torque control bracket, 174, will reduce the lifted section width, and thus reduce the engine torque;

(18) The shaft, 167, is rotated on bearings, 177, 178, at crankshaft speed, as by gears, 179;

(19) This barrel cam controller can also control the duration of opening of the gas fuel injector, 161, of FIG. 12, so that gas fuel is injected directly into air being concurrently transferred through the burner channel;

Those portions of the burner channel, through which hot burned gases flow, can be largely enclosed within the separate bypass channel as shown in FIG. 12 and FIG. 13. In this way, heat loss into the engine cooling jacket is reduced, and engine fuel efficiency improved. Heat transferred from the burned gases into the cooling jacket is lost for work output. But heat transferred from the burned gases into the bypass air flow can produce a work output during expansion.

Maximum engine torque can be obtained when all of the air, being transferred, from the air chamber, into the burned gas chamber, during each gas transfer time interval, passes through the burner channel, to be reacted therein with engine fuel. At reduced engine torque, some air will then pass through the bypass channel, and will not be reacted with fuel, and air only zones will thus be placed inside the burned gas volume, to function as insulation to reduce heat transfer into the engine cooling jacket, thus increasing fuel efficiency of the engine. For example, the air channel selector valve, 154, could be controlled, by the controller, 156, to pass air through the bypass channel, 151, at the start, and again at the end, of each gas transfer time interval. In this way two air only zones would be created, within the burned gas volume, the start air only zone tending to be positioned next to the gas crown of the displacer piston, the end air only zone tending to be positioned next to the gas cylinder head. These two air only zones can thus function as insulation to reduce heat transfer, from the hot burned gases, into the engine cooling jacket, via the gas cylinder head, and the displacer piston gas crown.

H. Beneficial Objects

To achieve the beneficial object of a piston engine, capable of long term operation with very little wear on abrasive ash producing fuels, such as coal, both the work producing compressor piston, and the non work producing displacer piston, are to operate together within a common cylinder. Pressures being essentially equal on both displacer piston crowns no sliding seals or rings are needed on the displacer piston. With a multifuel internal combustion Stirling engine of this invention, the burned gases containing abrasive ash particles are kept separate from the work producing compressor piston by the intervening displacer piston. In this way little or no abrasive wear need occur. This is a principal beneficial object of this invention, and makes feasible an engine with the multifuel capability, including coal, needed for national energy independence. Widespread use of these engines, would introduce interfuel price competition in addition to existing same fuel competition. Such interfuel price competition is a clear route to national energy independence, since known coal reserves, both national and international, are much grater than known reserves of petroleum and natural gas.

Having thus described my invention, what I claim is:

1. A multifuel internal combustion Stirling engine for producing power from combustion of fuels, and comprising:

an engine cylinder, comprising a gas cylinder head at one end of said cylinder, and further comprising an exhaust port, an air port, an air transfer port, and a burned gas port;

said exhaust port opening into said engine cylinder, and being located at the gas cylinder head end of said engine cylinder;

said burned gas port opening into said engine cylinder, and being located at the gas cylinder head end of said engine cylinder;

a displacer piston, operative within said engine cylinder, and comprising: a displacer piston gas crown at that end of said displacer piston facing said gas cylinder head, and said cylinder volume between said displacer piston gas crown and said gas cylinder head comprising a gas volume;

a compressor piston, sealably operative within said engine cylinder, and comprising: a compressor piston air crown at that end of said compressor piston facing said displacer piston;

said displacer piston further comprising a displacer piston air crown at that end of said displacer piston facing away from said gas cylinder head and facing said compressor piston, and said cylinder volume between said displacer piston air crown and said compressor piston air crown comprising an air volume;

compressor driver means for driving said compressor piston to move back and forth, within said engine cylinder, through a variable compressor piston displacement volume, on said air chamber side of said compressor piston, and so that said variable compressor piston displacement volume is a minimum of zero when said compressor piston is closest to said gas cylinder head, and is a maximum when said compressor piston is furthest away from said gas cylinder head;

the length of said back and forth motion of said compressor piston being the compressor piston stroke length;

said air intake port opening into said engine cylinder and being located along that portion of said engine cylinder through which said compressor piston moves back and forth, and further being located so that said air intake port is fully uncovered by said compressor piston when said variable compressor piston displacement volume is a maximum;

said air transfer port opening into said engine cylinder, and being located beyond that portion of said engine cylinder through which said compressor piston moves back and forth, in the direction of said gas cylinder head;

the distance between said burned gas port, and said air transfer port, being greater than the length of said displacer piston, between the gas side of said displacer piston gas crown, and the air side of said displacer piston air crown;

a divided combustion chamber, comprising an inlet connected to said air transfer port, and a gas outlet connected to said burned gas port, and further comprising a burner air channel and a separate bypass air flow channel;

an exhaust passage connected to said exhaust port, and comprising an exhaust valve with actuator means for opening and closing said exhaust passage;

exhaust valve driver means for opening and closing said exhaust passage, so that said exhaust passage is opened somewhat before said compressor piston uncovers said air intake port while moving away form said gas cylinder head, and so that said exhaust passage is subsequently closed somewhat after said compressor piston commences moving toward said gas cylinder head;

displacer driver means for driving said displacer piston to move through a displacer piston variable swept volume cycle, comprising the following sequence of time periods and displacer piston motions in time order;

a gas transfer time period during which the displacer piston moves toward the compressor piston, and increases said burned gas volume from a minimum value and decreases said air volume;

said gas transfer time period commencing somewhat before said variable compressor piston displacement volume reaches a minimum value on said air chamber side of said compressor piston;

said displacer piston motion, in combination with said compressor piston motion, during said gas transfer time period, causing gas to transfer from said air volume into said combustion chamber, via said combustion chamber air inlet;

said gas transfer time period ending somewhat after said variable compressor piston displacement volume passes said minimum value on said air chamber side of said compressor piston, and when said displacer piston motion has moved the displacer piston air crown past said air transfer port in a direction away from said gas cylinder head;

an expansion time period during which the displacer piston continues to move toward said compressor piston, and further increases said gas volume, said expansion time period following next after said gas transfer time period;

said expansion time period ending when said exhaust passage is opened somewhat before said compressor piston has passed said air inlet port, in a motion direction away from said gas cylinder head;

a scavenge time period during which the displacer piston motion reverses from first continuing to move toward said compressor piston, to next moving rapidly away from said compressor piston;

said scavenge time period commencing when said exhaust passage is opened and ending when said compressor piston has again passed said air inlet port, in a motion direction toward said gas cylinder head;

a compression time period during which the displacer piston essentially stops moving and said gas chamber volume remains essentially constant at its minimum value;

said compression time period following next after said scavenge time period, and ending when said compressor piston motion, toward said gas cylinder head, stops when said variable compressor piston displacement volume reaches a minimum value on said air chamber side of said compressor piston;

said displacer piston variable swept volume cycle being repeated, concurrently with said back and forth motion of said compressor piston through said variable compressor piston displacement volume;

said compressor driver means and said displacer piston driver means additionally operating, concurrently relative to each other, so that the volume of said air volume is always greater than zero;

said displacer piston driver means additionally operating relative to said gas cylinder head, so that the volume of said gas volume is always greater than zero;

a source of engine fuel;

fuel transfer means for transferring engine fuel from said engine fuel source into said burner air flow channel of said combustion chamber, so that said engine fuel is contacted with that air portion transferring through said burner air flow channel from said combustion chamber air inlet toward said combustion chamber gas outlet, during said gas transfer time period;

igniter means for igniting fuel and air within said combustion chamber during said gas transfer time period;

whereby said internal combustion Stirling engine carries out a power producing engine cycle, while operating through each said displacer piston variable swept volume cycle, the work input of compression, during said compression time period, being less than the work output of expansion, during said expansion time period, since occurrence of combustion, during said gas transfer time period, increases expansion pressures above compression pressures; these power producing cycles are repeated by discarding the burned gases to exhaust and refilling the engine cylinder with air during each scavenge time period.

2. A multifuel internal combustion Stirling engine as described in claim 1:

wherein said engine fuel is a solid fuel in chunks;

wherein said fuel transfer means transfers engine fuel from said source into said burner air flow channel of said combustion chamber, at intervals, so that a bed of solid fuel is always present within said burner air flow channel, and so that air transferring through said burner air flow channel during said gas transfer time period, passes through said bed of solid fuel;

and further comprising diverter valve engine torque control means for controlling engine torque by controlling the proportion of air being transferred during each said gas transfer time period, which passes through said burner air flow channel;

and further comprising:

a source of preheater fuel;

preheater fuel transfer means for transferring a quantity of preheater fuel, from said source of preheater fuel, into said burner air flow channel of said combustion chamber, while said internal combustion Stirling engine is being started, and during each said gas transfer time interval of starting;

spark igniter means for igniting each said preheater fuel quantity, within said combustion chamber, during each said gas transfer time interval of starting;

wherein said preheater fuel transfer means transfers said preheater fuel quantity into that portion of said burner air flow channel of said combustion chamber between said bed of solid fuel and said air transfer port.

3. A multifuel internal combustion Stirling engine as described in claim 1:

wherein said engine fuel is a solid fuel in chunks;

wherein said fuel transfer means transfers engine fuel from said source into said burner air flow channel of said combustion chamber, at intervals, so that a bed of solid fuel is always present within said burner air flow channel, and so that air transferring through said burner air flow channel during said gas transfer time period, passes through said bed of solid fuel;

and further comprising selector valve engine torque control means for controlling engine torque by controlling the proportion of each said gas transfer time period, during which all air being transferred through said combustion chamber passes through said burner air channel;

and further comprising:

a source of preheater fuel;

preheater fuel transfer means for transferring a quantity of preheater fuel, from said source of preheater fuel, into said burner air flow channel of said combustion chamber, while said internal combustion Stirling engine is being started, and during each said gas transfer time interval of starting;

spark igniter means for igniting each said preheater fuel quantity, within said combustion chamber, during each said gas transfer time interval of starting;

wherein said preheater fuel transfer means transfers said preheater fuel quantity into that portion of said burner air flow channel of said combustion chamber between said bed of solid fuel and said air transfer port.

4. A multifuel internal combustion Stirling engine as described in claim 2:

wherein the length of said displacer piston between the gas side of said displacer piston gas crown and the air side of said displacer piston air crown, at least equals the compressor piston stroke length;

whereby the portions of said engine cylinder swept over by said back and forth motion of said compressor piston, are not contacted by the gases inside said gas volume.

5. A multifuel internal combustion Stirling engine as described in claim 4:

wherein the outside diameter of said displacer piston is less than the outside diameter of said compressor piston;

wherein the inside diameter of that portion of said engine cylinder, between said gas cylinder head and said air transfer port, is less than the inside diameter of the remainder of said engine cylinder.

6. A multifuel internal combustion Stirling engine as described in claim 5:

wherein said combustion chamber air inlet comprises an air inlet valve and actuator for opening and closing said combustion chamber air inlet;

and further comprising air inlet valve driver means for opening and closing said combustion chamber air inlet so that said air inlet is closed during said scavenge time period, and is open during all other time periods.

7. A multifuel internal combustion Stirling engine as described in claim 5:

wherein said displacer piston further comprises a ported sleeve, added on to the gas crown end thereof, said sleeve ports being aligned to said exhaust port, and said burned gas port, so that said exhaust port and said burned gas port are always open to the interior of said ported sleeve;

and further wherein said gas cylinder head of said engine cylinder further comprises a sleeve recess, whose length in the direction of said displacer piston motion at least equals the length of said ported sleeve, so that said ported sleeve can move fully into said sleeve recess;

whereby some portions of said engine cylinder surfaces, swept over by said motion of said displacer piston are not contacted by the gases inside said gas volume.

8. A multifuel internal combustion Stirling engine as described in claim 3:

wherein the length of said displacer piston between the gas side of said displacer piston gas crown and the air side of said displacer piston air crown, at least equals the compressor piston stroke length;

whereby the portions of said engine cylinder swept over by said back and forth motion of said compressor piston, are not contacted by the gases inside said gas volume.

9. A multifuel internal combustion Stirling engine as described in claim 8:

wherein the outside diameter of said displacer piston is less than the outside diameter of said compressor piston;

wherein the inside diameter of that portion of said engine cylinder, between said gas cylinder head and said air transfer port, is less than the inside diameter of the remainder of said engine cylinder.

10. A multifuel internal combustion Stirling engine as described in claim 9:

wherein said combustion chamber air inlet comprises an air inlet valve and actuator for opening and closing said combustion chamber air inlet;

and further comprising air inlet valve driver means for opening and closing said combustion chamber air inlet so that said air inlet is closed during said scavenge time period, and is open during all other time periods.

11. A multifuel internal combustion Stirling engine as described in claim 9:

wherein said displacer piston further comprises a ported sleeve, added on to the gas crown end thereof, said sleeve ports being aligned to said exhaust port, and said burned gas port, so that said exhaust port and said burned gas port are always open to the interior of said ported sleeve;

and further wherein said gas cylinder head of said engine cylinder further comprises a sleeve recess, whose length in the direction of said displacer piston motion at least equals the length of said ported sleeve, so that said ported sleeve can move fully into said sleeve recess;

whereby some portions of said engine cylinder surfaces, swept over by said motion of said displacer piston are not contacted by the gases inside said gas volume.

12. A multifuel internal combustion Stirling engine for producing power from combustion of fuels, and comprising:

an engine cylinder, comprising a gas cylinder head at one end of said cylinder, and further comprising an exhaust port, an air port, an air transfer port, and a burned gas port;

said exhaust port opening into said engine cylinder, and being located at the gas cylinder head end of said engine cylinder;

said burned gas port opening into said engine cylinder, and being located at the gas cylinder head end of said engine cylinder;

a displacer piston, operative within said engine cylinder, and comprising: a displacer piston gas crown at that end of said displacer piston facing said gas cylinder head, and said cylinder volume between said displacer piston gas crown and said gas cylinder head comprising a gas volume;

a compressor piston, sealably operative within said engine cylinder, and comprising: a compressor piston air crown at that end of said compressor piston facing said displacer piston;

said displacer piston further comprising a displacer piston air crown at that end of said displacer piston facing away from said gas cylinder head and facing said compressor piston, and said cylinder volume between said displacer piston air crown and said compressor piston air crown comprising an air volume;

compressor driver means for driving said compressor piston to move back and forth, within said engine cylinder, through a variable compressor piston displacement volume, on said air chamber side of said compressor piston, and so that said variable compressor piston displacement volume is a minimum of zero when said compressor piston is closest to said gas cylinder head, and is a maximum when said compressor piston is furthest away from said gas cylinder head;

the length of said back and forth motion of said compressor piston being the compressor piston stroke length;

said air intake port opening into said engine cylinder and being located along that portion of said engine cylinder through which said compressor piston moves back and forth, and further being located so that said air intake port is fully uncovered by said compressor piston when said variable compressor piston displacement volume is a maximum;

said air transfer port opening into said engine cylinder, and being located beyond that portion of said engine cylinder through which said compressor piston moves back and forth, in the direction of said gas cylinder head;

the distance between said burned gas port, and said air transfer port, being greater than the length of said displacer piston, between the gas side of said displacer piston gas crown, and the air side of said displacer piston air crown;

a combustion chamber, comprising an inlet connected to said air transfer port, and a gas outlet connected to said burned gas port;

an exhaust passage connected to said exhaust port, and comprising an exhaust valve with actuator means for opening and closing said exhaust passage;

exhaust valve driver means for opening and closing said exhaust passage, so that said exhaust passage is opened somewhat before said compressor piston uncovers said air intake port while moving away form said gas cylinder head, and so that said exhaust passage is subsequently closed somewhat after said compressor piston commences moving toward said gas cylinder head;

displacer driver means for driving said displacer piston to move through a displacer piston variable swept volume cycle, comprising the following sequence of time periods and displacer piston motions in time order;

a gas transfer time period during which the displacer piston moves toward the compressor piston, and increases said gas volume from a minimum value and decreases said air volume;

said gas transfer time period commencing somewhat before said variable compressor piston displacement volume reaches a minimum value on said air chamber side of said compressor piston;

said displacer piston motion, in combination with said compressor piston motion, during said gas transfer time period, causing air to transfer from said air volume into said combustion chamber, via said combustion chamber air inlet;

said gas transfer time period ending somewhat after said variable compressor piston displacement volume passes said minimum value on said air chamber side of said compressor piston, and when said displacer piston motion has moved the displacer piston air crown past said air transfer port in a direction away from said gas cylinder head;

an expansion time period during which the displacer piston continues to move toward said compressor piston, and further increases said gas volume, said expansion time period following next after said gas transfer time period;

said expansion time period ending when said exhaust passage is opened somewhat before said compressor piston has passed said air inlet port, in a motion direction away from said gas cylinder head;

a scavenge time period during which the displacer piston motion reverses from first continuing to move toward said compressor piston, to next moving rapidly away from said compressor piston;

said scavenge time period commencing when said exhaust passage is opened and ending when said compressor piston has again passed said air inlet port, in a motion direction toward said gas cylinder head;

a compression time period during which the displacer piston essentially stops moving and said gas chamber volume remains essentially constant at its minimum value;

said compression time period following next after said scavenge time period, and ending when said compressor piston motion, toward said gas cylinder head, stops when said variable compressor piston displacement volume reaches a minimum value on said air chamber side of said compressor piston;

said displacer piston variable swept volume cycle being repeated, concurrently with said back and forth motion of said compressor piston through said variable compressor piston displacement volume;

said compressor driver means and said displacer piston driver means additionally operating, concurrently relative to each other, so that the volume of said air volume is always greater than zero;

said displacer piston driver means additionally operating relative to said gas cylinder head, so that the volume of said gas volume is always greater than zero;

a source of engine fuel wherein said engine fuel is selected from the group of fuels consisting of, liquid, fuel, liquid in immiscible liquid slurry fuel, solid in liquid slurry fuel;

and further comprising fuel transfer means for transferring engine fuel from said engine fuel source into said combustion chamber, and comprising an aspirator means for transferring fuel, said aspirator transfer means comprising:

a venturi means for accelerating the compressed air being transferred from said air volume through said combustion chamber, toward said gas chamber during said gas transfer time period, and comprising a venturi throat within said combustion chamber, whose throat flow area is less than the flow area of an upstream combustion chamber portion between said venturi throat and said air transfer port;

a fuel cavity whose interior volume is at least equal to the maximum volume of fuel transferred per engine cycle from said engine fuel source;

a timed metering pump means for pumping a fuel quantity from said engine fuel source into said fuel cavity, during each engine cycle and prior to the start of said gas transfer time interval, and comprising unidirectional flow means so that flow occurs only from said metering pump into said fuel cavity;

a fuel timing orifice in said venturi throat and connected to the bottom of said fuel cavity;

an upstream pressure connection from the top of said fuel cavity to that upstream combustion chamber portion whose flow area is greater than the flow area of said venturi throat;

whereby the flow of compressed air through said venturi throat in said combustion chamber, during said gas transfer time period, will create a higher pressure in said fuel cavity than the pressure in said venturi throat, and this pressure difference will force the metered fuel quantity inside said fuel cavity to flow through said fuel timing orifice into the compressed air flowing through said venturi throat, thus creating a suspension of atomized fuel in compressed air, flowing toward said burned gas port;

and further comprising:

a source of pilot igniter fuel;

igniter fuel transfer means for transferring a quantity of pilot igniter fuel, from said source of pilot igniter fuel into said combustion chamber, during each said gas transfer time interval;

spark igniter means for igniting said pilot igniter fuel within said combustion chamber, during each said gas transfer time interval;

wherein said igniter fuel transfer means transfers said igniter fuel quantity into that portion of said combustion chamber, through which said suspension of atomized slurry fuel in compressed air flows, during said gas transfer time interval;

and further comprising engine torque control means for controlling engine torque by controlling the fuel quantity transferred into said fuel cavity during each engine cycle.

13. A multifuel internal combustion Stirling engine as described in claim 12:

wherein the length of said displacer piston between the gas side of said displacer piston gas crown and the air side of said displacer piston air crown, at least equals the compressor piston stroke length;

whereby the portions of said engine cylinder swept over by said back and forth motion of said compressor piston, are not contacted by the gases inside said gas volume.

14. A multifuel internal combustion Stirling engine as described in claim 13:

wherein the outside diameter of said displacer piston is less than the outside diameter of said compressor piston;

wherein the inside diameter of that portion of said engine cylinder, between said gas cylinder head and said air transfer port, is less than the inside diameter of the remainder of said engine cylinder.

15. A multifuel internal combustion Stirling engine as described in claim 14:

wherein said combustion chamber air inlet comprises an air inlet valve and actuator for opening and closing said combustion chamber air inlet;

and further comprising air inlet valve driver means for opening and closing said combustion chamber air inlet so that said air inlet is closed during said scavenge time period, and is open during all other time periods.

16. A multifuel internal combustion Stirling engine as described in claim 14:

wherein said displacer piston further comprises a ported sleeve, added on to the gas crown end thereof, said sleeve ports being aligned to said exhaust port, and said burned gas port, so that said exhaust port and said burned gas port are always open to the interior of said ported sleeve;

and further wherein said gas cylinder head of said engine cylinder further comprises a sleeve recess, whose length in the direction of said displacer piston motion at least equals the length of said ported sleeve, so that said ported sleeve can move fully into said sleeve recess;

whereby some portions of said engine cylinder surfaces, swept over by said motion of said displacer piston are not contacted by the gases inside said gas volume.

* * * * *

UNITED STATES PATENT AND TRADEMARK OFFICE

CERTIFICATE OF CORRECTION

PATENT NO. : 6,457,309 B1
DATED : October 1, 2002
INVENTOR(S) : Joseph C. Firey

It is certified that error appears in the above-identified patent and that said Letters Patent is hereby corrected as shown below:

Column 5,
Line 43, change "1C", to -- 1E --;

Column 7,
Line 54, add a semicolon between $$\frac{(VAO) - (VAX)}{(AC)}, \text{ and, } \left[(ro) - (rc)\right];$$

Column 12,
Line 56, change " $\frac{1}{f}$, to, -- $\frac{1}{f(r)}$ --

Column 19,
Line 25, change "value", to -- valve --;

Column 21,
Line 61, change "form", to -- from --;

Signed and Sealed this

Eighth Day of April, 2003

JAMES E. ROGAN
*Director of the United States Patent and Trademark Office*